US009448516B2

(12) United States Patent
Ishigaya et al.

(10) Patent No.: US 9,448,516 B2
(45) Date of Patent: Sep. 20, 2016

(54) FIXING DEVICE TEMPERATURE CONTROL METHOD, FIXING DEVICE, AND IMAGE FORMING APPARATUS

(71) Applicants: Yasunori Ishigaya, Kanagawa (JP); Masahiro Samei, Osaka (JP); Ryota Yamashina, Kanagawa (JP); Takumi Waida, Kanagawa (JP)

(72) Inventors: Yasunori Ishigaya, Kanagawa (JP); Masahiro Samei, Osaka (JP); Ryota Yamashina, Kanagawa (JP); Takumi Waida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/039,163

(22) Filed: Sep. 27, 2013

(65) Prior Publication Data

US 2014/0099138 A1 Apr. 10, 2014

(30) Foreign Application Priority Data

Oct. 10, 2012 (JP) ..... 2012-225109

(51) Int. Cl.
*G03G 15/20* (2006.01)

(52) U.S. Cl.
CPC ..... *G03G 15/2078* (2013.01); *G03G 15/2039* (2013.01); *G03G 15/2046* (2013.01); *G03G 15/2064* (2013.01)

(58) Field of Classification Search
CPC ..... G03G 15/2078; G03G 15/2039; G03G 15/2046
USPC ..... 399/69
See application file for complete search history.

(56) References Cited

U.S. PATENT DOCUMENTS

| | | | | |
|---|---|---|---|---|
| 2005/0191075 | A1* | 9/2005 | Kimizuka et al. | 399/69 |
| 2009/0169232 | A1 | 7/2009 | Kunii et al. | |
| 2010/0008683 | A1 | 1/2010 | Yoshikawa | |
| 2011/0222927 | A1 | 9/2011 | Yamashina | |
| 2011/0299899 | A1 | 12/2011 | Ishigaya et al. | |
| 2012/0093532 | A1 | 4/2012 | Ishigaya et al. | |
| 2012/0093534 | A1 | 4/2012 | Waida et al. | |
| 2012/0148287 | A1 | 6/2012 | Samei et al. | |
| 2012/0148317 | A1 | 6/2012 | Samei et al. | |
| 2012/0243895 | A1 | 9/2012 | Samei et al. | |
| 2013/0051826 | A1* | 2/2013 | Chiyoda | 399/69 |
| 2013/0051876 | A1 | 2/2013 | Ishigaya et al. | |

FOREIGN PATENT DOCUMENTS

| | | | |
|---|---|---|---|
| JP | 60150075 A | * | 8/1985 |
| JP | 8-137341 | | 5/1996 |

(Continued)

OTHER PUBLICATIONS

Office Action dated Jun. 21, 2016 in Japanese Patent Application No. 2012-225109.

*Primary Examiner* — Walter L Lindsay, Jr.
*Assistant Examiner* — Ruth Labombard
(74) *Attorney, Agent, or Firm* — Harness, Dickey & Pierce, P.L.C.

(57) ABSTRACT

A fixing device temperature control method is performed by a fixing device including a heat conductor contacting and heating an unfixed toner image formed on a recording medium, a heater disposed opposite and heating the heat conductor, and a pressing roller pressed against the heat conductor to form a fixing nip between the heat conductor and the pressing roller through which the recording medium is conveyed. The method includes detecting a temperature of the pressing roller and controlling an input voltage to the heater based on the detected temperature of the pressing roller to maintain a temperature of the recording medium discharged from the fixing nip at a target temperature.

19 Claims, 18 Drawing Sheets

(56) References Cited

FOREIGN PATENT DOCUMENTS

| | | |
|---|---|---|
| JP | 2004-212701 A | 7/2004 |
| JP | 2006-195422 | 7/2006 |
| JP | 2008-139780 | 6/2008 |
| JP | 2009-031651 | 2/2009 |
| JP | 2010-019870 | 1/2010 |
| JP | 2012-103671 A | 5/2012 |

* cited by examiner

FIXING DEVICE TEMPERATURE CONTROL METHOD, FIXING DEVICE, AND IMAGE FORMING APPARATUS

CROSS-REFERENCE TO RELATED APPLICATION

This patent application is based on and claims priority pursuant to 35 U.S.C. §119 to Japanese Patent Application No. 2012-225109, filed on Oct. 10, 2012, in the Japanese Patent Office, the entire disclosure of which is hereby incorporated by reference herein.

BACKGROUND

1. Technical Field

Example embodiments generally relate to a fixing device temperature control method, a fixing device, and an image forming apparatus, and more particularly, to a fixing device temperature control method performed by a fixing device for fixing a toner image on a recording medium, the fixing device, and an image forming apparatus incorporating the fixing device.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a heat conductor, such as a fixing roller and a fixing belt, and a pressing roller pressed against the heat conductor to form a fixing nip therebetween through which a recording medium bearing a toner image is conveyed. As the recording medium passes through the fixing nip, the heat conductor heated by a heater and the pressing roller apply heat and pressure to the recording medium to melt and fix the toner image on the recording medium.

The image forming apparatuses incorporating such a fixing device are required to form the toner image on various types of the recording media such as coated and uncoated paper and thin and thick paper. Additionally, the low-speed image forming apparatuses may convey fewer recording media at low speed and may be turned off after printing. Conversely, the high-speed image forming apparatuses may convey more recording media at high speed continuously. Under those conditions, the fixing device incorporated in such image forming apparatuses is required to achieve a desired fixing quality consistently.

To address this requirement, the image forming apparatus may change one or more image forming conditions for forming the toner image according to information about the recording medium input by a user, as disclosed by JP-H08-137341-A.

Alternatively, the fixing device may change a fixing condition for fixing the toner image on the recording medium according to information about the recording medium such as the surface property, the thickness, and the moisture content of the recording medium, as disclosed by JP-2006-195422-A.

At the same time, to save energy, the fixing device may be configured so as to not control the temperature of the pressing roller that does not contact an unfixed toner image. However, if the temperature of the pressing roller is not controlled during a print job, fluctuation in the temperature of the pressing roller may adversely affect fixing quality. For example, since the heat conductor is heated sufficiently to achieve the desired fixing quality even if the temperature of the pressing roller is relatively high, the pressing roller may overheat, which in turn overheats the recording medium. Accordingly, without controlling the temperature of the pressing roller, the temperature of the recording medium may fluctuate, varying fixing quality and wasting energy.

SUMMARY

At least one embodiment provides a novel fixing device temperature control method performed by a fixing device including a heat conductor contacting and heating an unfixed toner image formed on a recording medium, a heater disposed opposite and heating the heat conductor, and a pressing roller pressed against the heat conductor to form a fixing nip between the heat conductor and the pressing roller through which the recording medium is conveyed. The fixing device temperature control method includes detecting a temperature of the pressing roller and controlling an input voltage to the heater based on the detected temperature of the pressing roller to maintain a temperature of the recording medium discharged from the fixing nip at a target temperature.

At least one embodiment provides a novel fixing device that includes a heat conductor contacting and heating an unfixed toner image formed on a recording medium and a heater disposed opposite and heating the heat conductor. A pressing roller is pressed against the heat conductor to form a fixing nip between the heat conductor and the pressing roller through which the recording medium is conveyed. A pressing roller sensor is disposed opposite the pressing roller to detect a temperature of the pressing roller. A temperature controller is operatively connected to the pressing roller sensor. A power controller is operatively connected to the temperature controller and the heater to control an input voltage to the heater based on the temperature of the pressing roller detected by the pressing roller sensor to maintain a temperature of the recording medium discharged from the fixing nip at a target temperature.

At least one embodiment provides a novel image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
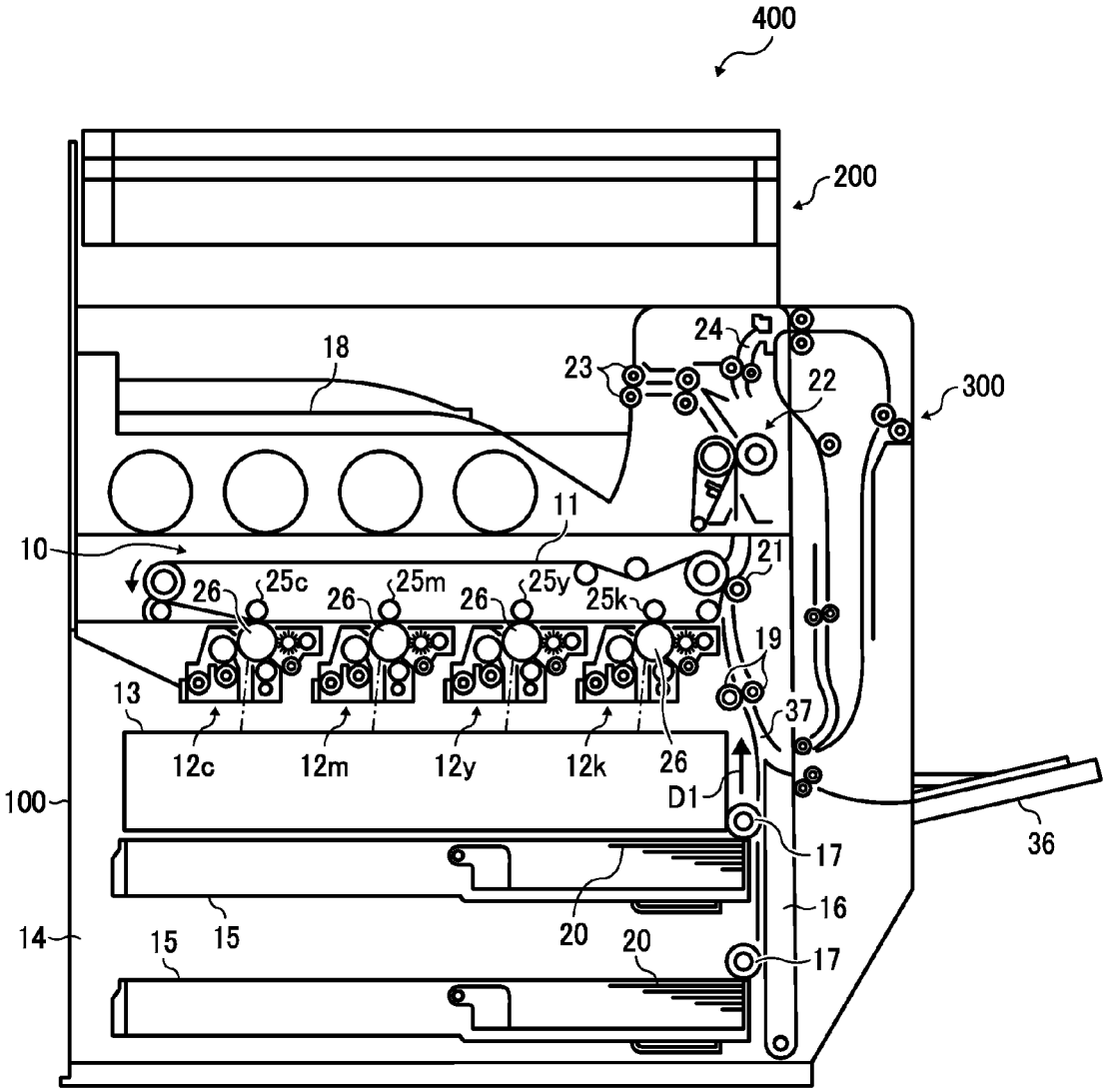
FIG. 1 is a schematic vertical sectional view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 400 according to an example embodiment is explained.

FIG. 1 is a schematic vertical sectional view of the image forming apparatus 400. The image forming apparatus 400 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 400 is a tandem color copier that forms color and monochrome toner images on recording media by electrophotography.

The image forming apparatus 400 includes a body 100, an image reader 200 placed on the body 100, and a duplex unit 300 attached to a right side of the body 100. The body 100 includes an intermediate transfer device 10 that incorporates an endless, intermediate transfer belt 11 stretched taut across a plurality of rollers. The intermediate transfer belt 11 extending substantially horizontally is rotatable counterclockwise in FIG. 1.

Below the intermediate transfer device 10 are four image forming devices 12*c*, 12*m*, 12*y*, and 12*k* that form cyan, magenta, yellow, and black toner images, respectively. The image forming devices 12*c*, 12*m*, 12*y*, and 12*k* are aligned in tandem along a lower face of the intermediate transfer belt 11. Each of the image forming devices 12*c*, 12*m*, 12*y*, and 12*k* includes a drum-shaped photoconductor 26 serving as an image carrier rotatable clockwise in FIG. 1 and surrounded by a charger, a development device, a primary transfer device, and a cleaner. Primary transfer devices 25*c*, 25*m*, 25*y*, and 25*k* are disposed opposite the photoconductors 26, respectively, via the intermediate transfer belt 11. Below the image forming devices 12*c*, 12*m*, 12*y*, and 12*k* is an exposure device 13.

Below the exposure device 13 is a sheet feeder 14. The sheet feeder 14 includes two paper trays 15 aligned vertically and containing a plurality of recording media 20. Each paper tray 15 mounts a feed roller 17 on an upper right side thereof. The feed roller 17 picks up and feeds an uppermost recording medium 20 from the plurality of recording media 20 loaded on the paper tray 15 into a main path 16.

The main path 16 extends upward from a right bottom to a right top of the body 100 and communicates with an internal output tray 18 situated atop the body 100 and interposed between the body 100 and the image reader 200. The main path 16 is substantially vertically aligned with a registration roller pair 19, a secondary transfer device 21 disposed opposite the intermediate transfer belt 11, a fixing device 22, and an output device 23 constructed of an output roller pair. Upstream from the registration roller pair 19 in a recording medium conveyance direction D1 is a bypass 37 in communication with the duplex unit 300 and the main path 16. The bypass 37 receives the recording medium 20 from the duplex unit 300 or from a bypass tray 36 attached to the duplex unit 300 and conveys the recording medium 20 to the main path 16. Downstream from the fixing device 22 in the recording medium conveyance direction D1 is a duplex path 24 branching from the main path 16 and communicating with the duplex unit 300.

A description is provided of a copying operation to form a color toner image on a recording medium 20 performed by the image forming apparatus 400 having the structure described above.

As the image forming apparatus 400 receives a print job, the image reader 200 reads an image on an original into image data. The exposure device 13 writes an electrostatic latent image on the photoconductor 26 of the respective image forming devices 12*c*, 12*m*, 12*y*, and 12*k* according to the image data created by the image reader 200. The development devices of the image forming devices 12*c*, 12*m*, 12*y*, and 12*k* visualize the electrostatic latent images as cyan, magenta, yellow, and black toner images, respectively. The primary transfer devices 25*c*, 25*m*, 25*y*, and 25*k* primarily transfer the cyan, magenta, yellow, and black toner images formed on the photoconductors 26 onto the intermediate transfer belt 11 successively such that the cyan, magenta, yellow, and black toner images are superimposed on a same position on the intermediate transfer belt 11, thus forming a color toner image thereon.

On the other hand, one of the two feed rollers 17 is selectively rotated to pick up and feed a recording medium 20 from the corresponding paper tray 15 to the main path 16. Alternatively, a recording medium 20 placed on the bypass tray 36 is conveyed to the main path 16 through the bypass 37. The registration roller pair 19 situated in the main path 16 conveys the recording medium 20 to a secondary transfer nip formed between the secondary transfer device 21 and the intermediate transfer belt 11 at a proper time when the color toner image formed on the intermediate transfer belt 11 reaches the secondary transfer nip. As the recording medium 20 is conveyed through the secondary transfer nip, the secondary transfer device 21 secondarily transfers the color toner image formed on the intermediate transfer belt 11 onto the recording medium 20. After the secondary transfer, the fixing device 22 fixes the color toner image on the recording medium 20. Thereafter, the output device 23 discharges the recording medium 20 bearing the fixed color toner image onto the internal output tray 18 where the recording medium 20 is stacked.

If the image forming apparatus 400 receives a duplex print job, the recording medium 20 bearing the fixed color toner image on a front side thereof is conveyed to the duplex unit 300 through the duplex path 24. The duplex unit 300 reverses and conveys the recording medium 20 to the main path 16 through the bypass 37. As the recording medium 20 is conveyed through the secondary transfer nip, another color toner image formed on the intermediate transfer belt 11 is secondarily transferred onto a back side of the recording medium 20. Thereafter, the fixing device 22 fixes the color toner image on the recording medium 20 and the output device 23 discharges the recording medium 20 bearing the fixed color toner image on both sides thereof onto the internal output tray 18.

Figure 2:
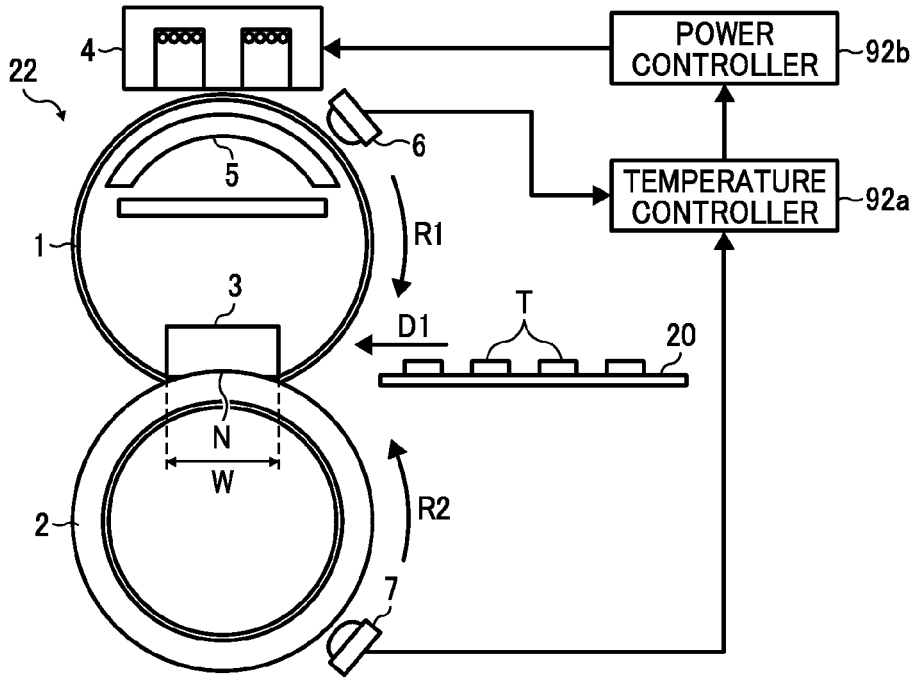
FIG. 2 is a vertical sectional view of a fixing device incorporated in the image forming apparatus shown in FIG. 1.

With reference to FIG. 2, a description is provided of a configuration of the fixing device 22 incorporated in the image forming apparatus 400 described above.

FIG. 2 is a schematic vertical sectional view of the fixing device 22. As shown in FIG. 2, the fixing device 22 (e.g., a fuser) includes an endless belt 1, serving as a heat conductor, formed into a loop and rotatable clockwise in FIG. 2 in a rotation direction R1 and a pressing roller 2 serving as a pressing member disposed opposite the endless belt 1 and rotatable counterclockwise in FIG. 2 in a rotation direction R2. A nip formation pad 3 situated inside the loop formed by the endless belt 1 presses the endless belt 1 against the pressing roller 2 to form a fixing nip N between the endless belt 1 and the pressing roller 2 through which a recording medium 20 bearing a toner image T is conveyed. As the recording medium 20 is conveyed through the fixing nip N, the unfixed toner image T on the recording medium 20 faces the endless belt 1. A heat generator 5 is situated inside the loop formed by the endless belt 1. A coil 4 is situated outside the loop formed by the endless belt 1 and produces a magnetic field that causes the heat generator 5 to generate heat. A sensor 6, serving as a heat conductor sensor, is disposed opposite an outer circumferential surface of the endless belt 1 and serves as a detector that detects the temperature of the endless belt 1. A sensor 7, serving as a pressing roller sensor, is disposed opposite an outer circumferential surface of the pressing roller 2 and serves as a detector that detects the temperature of the pressing roller 2. A power controller 92*b* is operatively connected to the coil 4 to control power supplied to the coil 4. A temperature controller 92*a* is operatively connected to the sensors 6 and 7 and the power controller 92*b* to control, i.e., provide an instruction to, the power controller 92*b* based on the temperature of the endless belt 1 detected by the sensor 6 and the temperature of the pressing roller 2 detected by the sensor 7.

In order to change the temperature of the endless belt 1 facing the toner image T on the recording medium 20 quickly under various conditions, the fixing device 22 employs an induction heater that is responsive to temperature.

Further, the fixing device 22 employs a control method to control induction heating by an input voltage. For example, a heater of which input voltage is unchangeable, such as a halogen heater, employs a DUTY control to control a turn-on time per hour that is susceptible to temperature fluctuation of the endless belt 1 that may arise while the heater is turned off. To address this circumstance, the fixing device 22 employs the control method to control induction heating by the input voltage as described below, thus controlling the temperature of the recording medium 20 heated by the endless belt 1.

The power controller 92*b* controls power input to the coil 4 such that the endless belt 1 heated by the coil 4 and the heat generator 5 conducts a given amount of heat to the recording medium 20 and the toner image T formed thereon. In the description below, a nip conveyance time defines a time for which the recording medium 20 is conveyed through the fixing nip N that is obtained by dividing a fixing nip width W of the fixing nip N by a conveyance speed of the recording medium 20. While the recording medium 20 is conveyed through the fixing nip N, a particular point on the toner image T on the recording medium 20 is heated by the endless belt 1 and the pressing roller 2 for the nip conveyance time.

Figure 3:
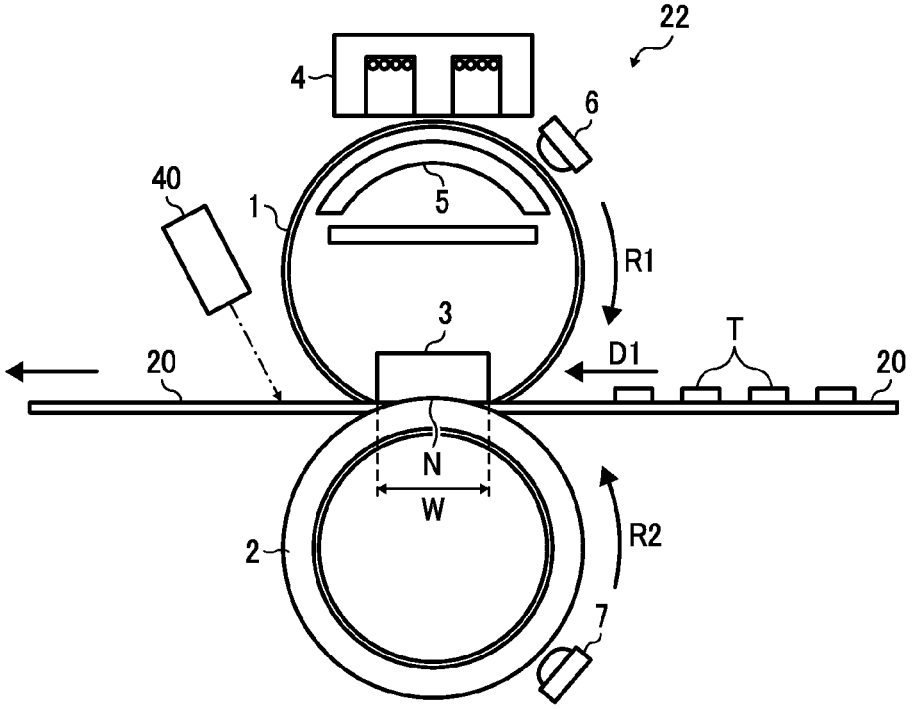
FIG. 3 is a vertical sectional view of the fixing device shown in FIG. 2 illustrating a non-contact temperature sensor incorporated therein.
Figure 4:
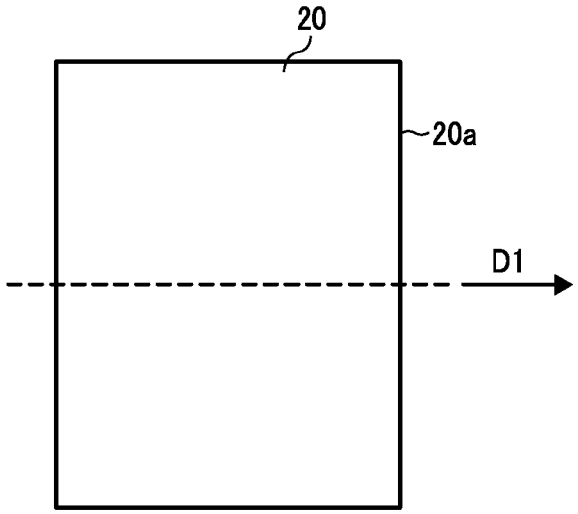
FIG. 4 is a plan view of a recording medium conveyed through the fixing device shown in FIG. 2.

With reference to FIGS. 3 and 4, a description is provided of a method for measuring the temperature of the recording medium 20 bearing the fixed toner image T that is discharged from the fixing nip N by using a temperature sensor.

FIG. 3 is a schematic vertical sectional view of the fixing device 22 illustrating a non-contact temperature sensor 40. As shown in FIG. 3, the temperature sensor 40 is situated downstream from and in proximity to an exit of the fixing nip N to detect the temperature of the recording medium 20 discharged from the fixing nip N immediately after it is discharged from the fixing nip N. The temperature sensor 40 may be a temperature sensor FT-H20 available from Keyence Corporation.

FIG. 4 is a plan view of the recording medium 20. FIG. 4 illustrates a temperature detection position on the recording medium 20 where the temperature sensor 40 detects the temperature of the recording medium 20. According to this example embodiment, an A4 size sheet is used as a recording medium 20. A leading edge 20*a* of the recording medium 20 conveyed in the recording medium conveyance direction D1 defines a long edge of the recording medium 20. As the recording medium 20 is conveyed through the fixing device 22 in the recording medium conveyance direction D1, the temperature sensor 40 detects the temperature of the recording medium 20 at the temperature detection position indicated by the dotted line that extends in the recording medium conveyance direction D1 through a substantially center of the recording medium 20 in an axial direction of the endless belt 1 perpendicular to the recording medium conveyance direction D1.

Figure 5:
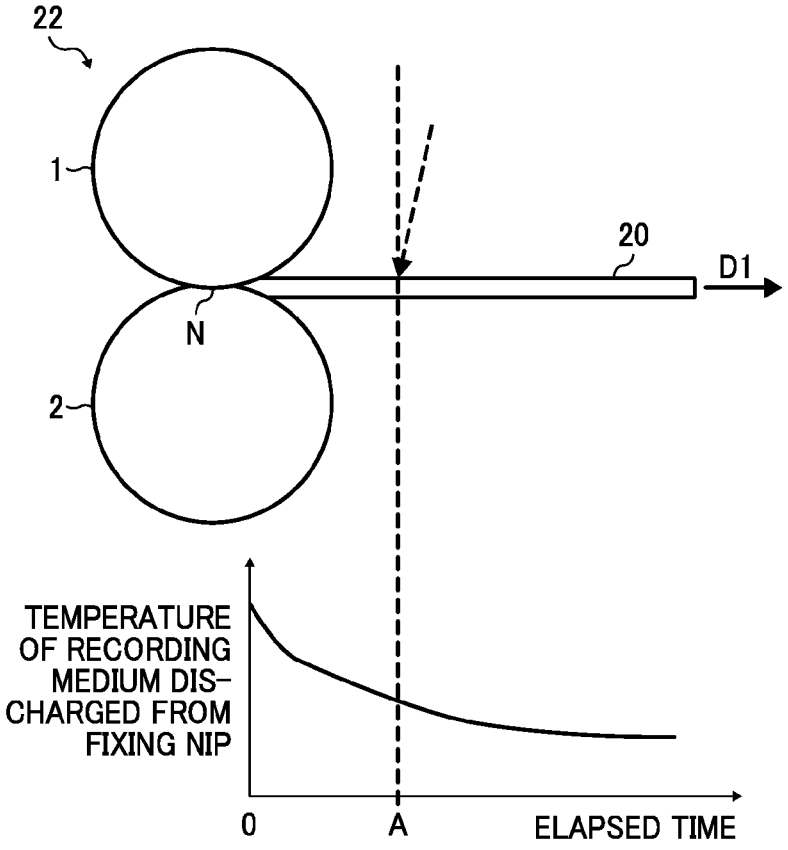
FIG. 5 is a diagram illustrating the recording medium discharged from a fixing nip of the fixing device shown in FIG. 2 and a graph showing the temperature of the recording medium changing over time.

With reference to FIG. 5, a description is provided of change in temperature of the recording medium 20 discharged from the fixing nip N as it is conveyed in the recording medium conveyance direction D1.

FIG. 5 is a diagram illustrating the recording medium 20 discharged from the fixing nip N formed between the endless belt 1 and the pressing roller 2 and a graph showing the temperature of the recording medium 20 changing over time. For example, the graph shows a relation between an elapsed time elapsed after the recording medium 20 is discharged from the fixing nip N and the temperature of the recording medium 20. The recording medium 20 is heated as it is conveyed through the fixing nip N and cooled by air after it is discharged from the fixing nip N. As time elapses, the temperature of the recording medium 20 decreases gradually as shown in FIG. 5. In order to detect the temperature of the recording medium 20 at which the toner image T is fixed on the recording medium 20 precisely, it is preferable that the temperature sensor 40 depicted in FIG. 3 is situated as close as possible to the fixing nip N. However, in view of limited space, the temperature sensor 40 is spaced apart from the exit of the fixing nip N by a distance in a range of from about 10 mm to about 30 mm or situated at a position A where the temperature sensor 40 detects the temperature of the recording medium 20 when a time in a range of from about 50 msec to about 300 msec elapses after the recording medium 20 is discharged from the fixing nip N.

Figure 6:
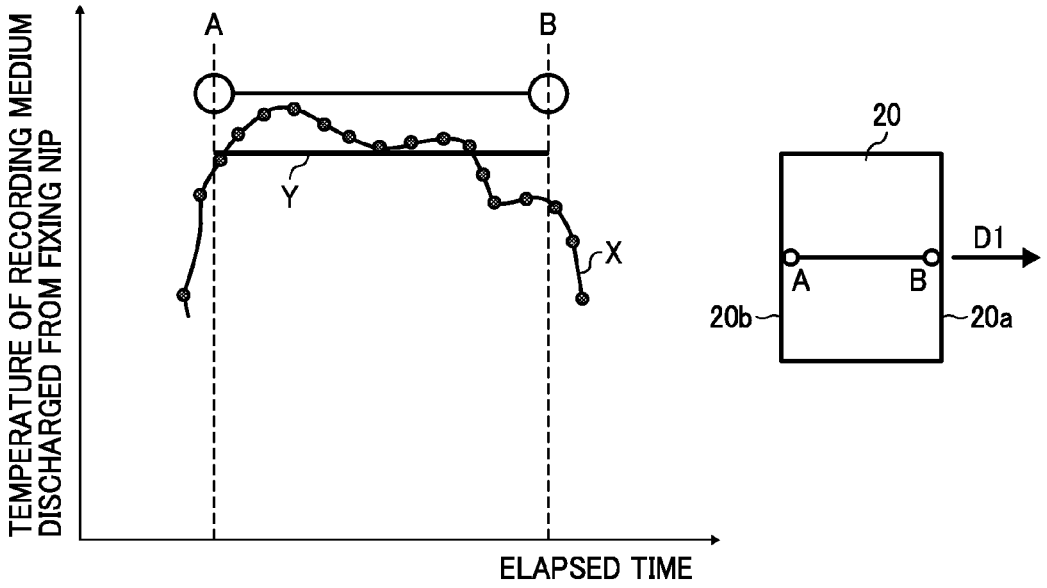
FIG. 6 is a graph showing a relation between the elapsed time elapsed after the recording medium is discharged from the fixing nip of the fixing device shown in FIG. 2 and the temperature of the recording medium.

With reference to FIG. 6, a description is provided of definition of the temperature of the recording medium 20 detected by the temperature sensor 40.

FIG. 6 is a graph showing a relation between the elapsed time elapsed after the recording medium 20 is discharged from the fixing nip N and the temperature of the recording medium 20, which is obtained by a measurement. The temperature sensor 40 detects the temperature of the recording medium 20 discharged from the fixing nip N using a sampling period of 10 ms. A temperature wave X is obtained by the measurement. Temperatures of the recording medium 20 detected by the temperature sensor 40 are taken from the temperature wave X. Since the temperature sensor 40 has a spot diameter, temperatures in a region between positions B and A defined by the leading edge 20*a* and a trailing edge 20*b* of the recording medium 20 in the recording medium conveyance direction D1, respectively, where all spots of the temperature sensor 40 are on the recording medium 20, are taken from the temperature wave X. An average Y obtained from the temperatures taken from the temperature wave X defines the temperature of the recording medium 20 discharged from the fixing nip N.

A description is provided of a relation between the temperature of the recording medium 20 discharged from the fixing nip N and fixing property, that is, fixing strength with which the toner image T is fixed on the recording medium 20 and gloss level of the toner image T fixed on the recording medium 20.

First, with reference to FIGS. 7A to 10, a description is given of a relation between the temperature of the recording medium 20 discharged from the fixing nip N and the fixing strength.

Figure 7A:
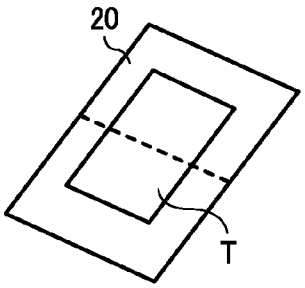
FIG. 7A is a perspective view of the recording medium bearing a fixed toner image before being folded.
Figure 7B:
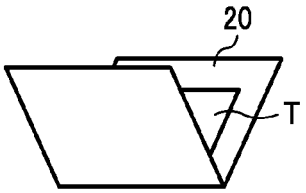
FIG. 7B is a perspective view of the recording medium shown in FIG. 7A folded gently such that the toner image fixed on the recording medium is disposed opposite each other.
Figure 7C:
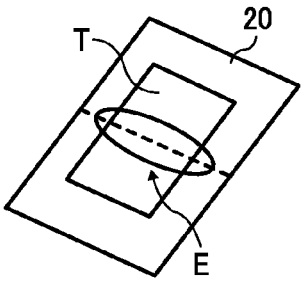
FIG. 7C is a perspective view of the unfolded recording medium shown in FIG. 7B.

The fixing strength is evaluated by observing how much toner peels off the recording medium 20 as the recording medium 20 is folded and graded as below. FIGS. 7A to 7C illustrate diagrams showing the recording medium 20 folded and unfolded for evaluation.

Figure 8:
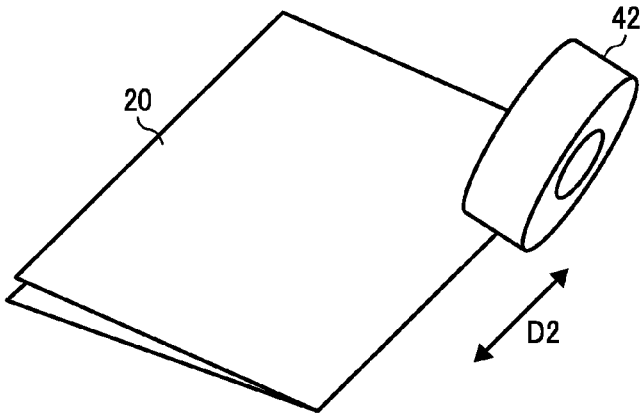
FIG. 8 is a perspective view of the folded recording medium shown in FIG. 7B illustrating a weight rolling thereon.

FIG. 7A is a perspective view of the recording medium 20 bearing the fixed toner image T before being folded. FIG. 7B is a perspective view of the recording medium 20 folded gently such that the toner image T fixed on the recording medium 20 is disposed opposite each other. FIG. 7C is a perspective view of the unfolded recording medium 20. FIG. 8 is a perspective view of the folded recording medium 20. As shown in FIG. 8, a weight 42 placed on the folded recording medium 20 rolls on the recording medium 20 in a direction D2 to create a fold thereon. The weight 42 is a cylinder having a width of 50 mm and a weight of 1 kg. The weight 42 rolls on a folded part of the recording medium 20 back and forth once, creating a fold on the recording medium 20. After the recording medium 20 is unfolded as shown in FIG. 7C, a waste gently slides over the toner image T in an evaluation region E, removing toner peeled off the recording medium 20 therefrom.

Figure 9:
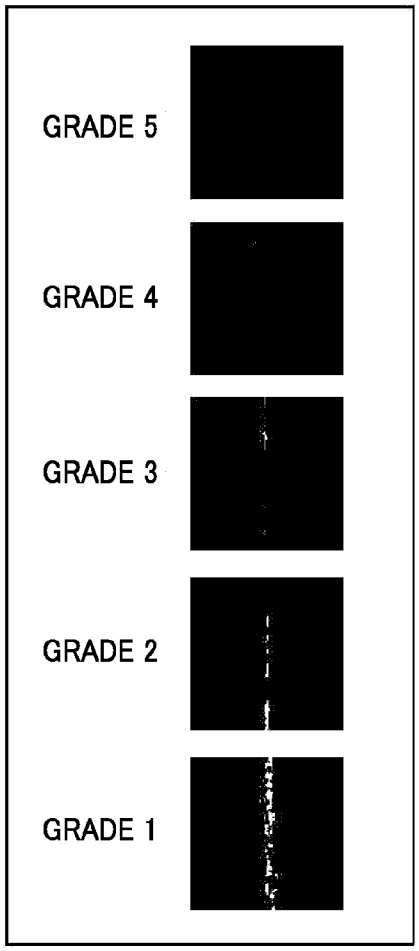
FIG. 9 is a diagram illustrating toner image patterns of the toner image on the recording medium shown in FIG. 7C graded 1 to 5.

The toner image T in the evaluation region E depicted in FIG. 7C is evaluated in five grades shown in FIG. 9 to determine the fixing strength. FIG. 9 is a diagram illustrating toner image patterns of the toner image T in the evaluation region E graded 1 to 5. The toner image pattern of grade 1 illustrates the toner image T where toner is peeled off throughout the evaluation region E. The toner image pattern of grade 5 illustrates the toner image T where no toner is peeled off.

Figure 10:
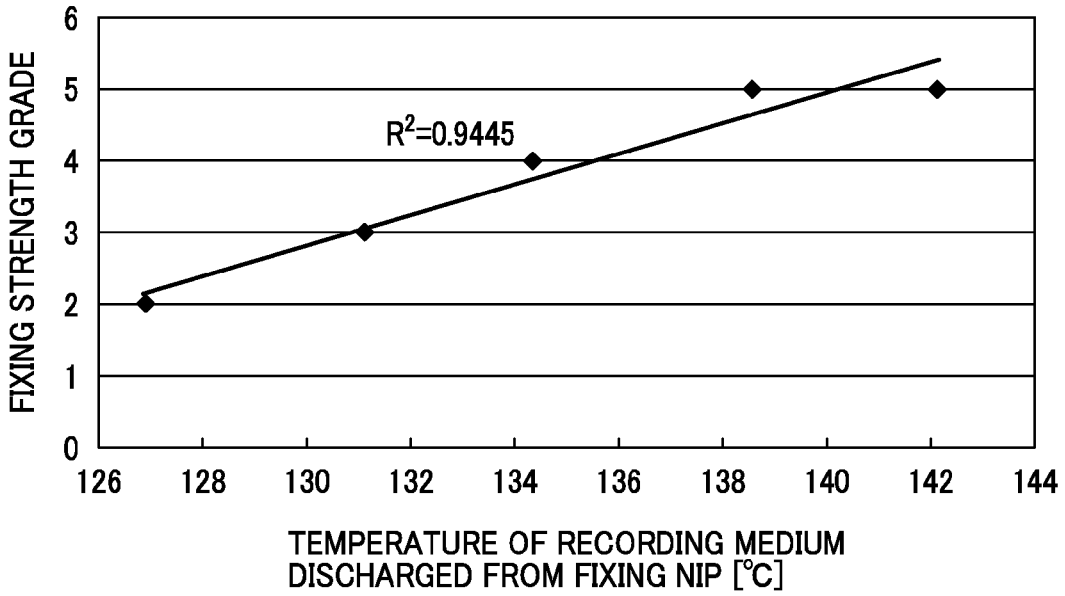
FIG. 10 is a graph showing a relation between the temperature of the recording medium discharged from the fixing nip of the fixing device shown in FIG. 2 and the fixing strength graded 1 to 5 shown in FIG. 9.

FIG. 10 is a graph showing a relation between the temperature of the recording medium 20 discharged from the fixing nip N and the fixing strength graded 1 to 5 shown in FIG. 9. As shown in FIG. 10, the temperature of the recording medium 20 discharged from the fixing nip N shows a strong correlation with the fixing strength grade. For example, the graph depicted in FIG. 10 shows the correlation under an ambient temperature of 23 degrees centigrade, a humidity of 50 percent, a temperature of the endless belt 1 of 180 degrees centigrade, and a paper weight of the recording medium 20 of 90 g/m$^2$. When the temperature of the recording medium 20 discharged from the fixing nip N is in a range of from about 126 degrees centigrade to about 144 degrees centigrade, as the temperature of the recording medium 20 discharged from the fixing nip N increases, the fixing strength grade increases.

Figure 11:
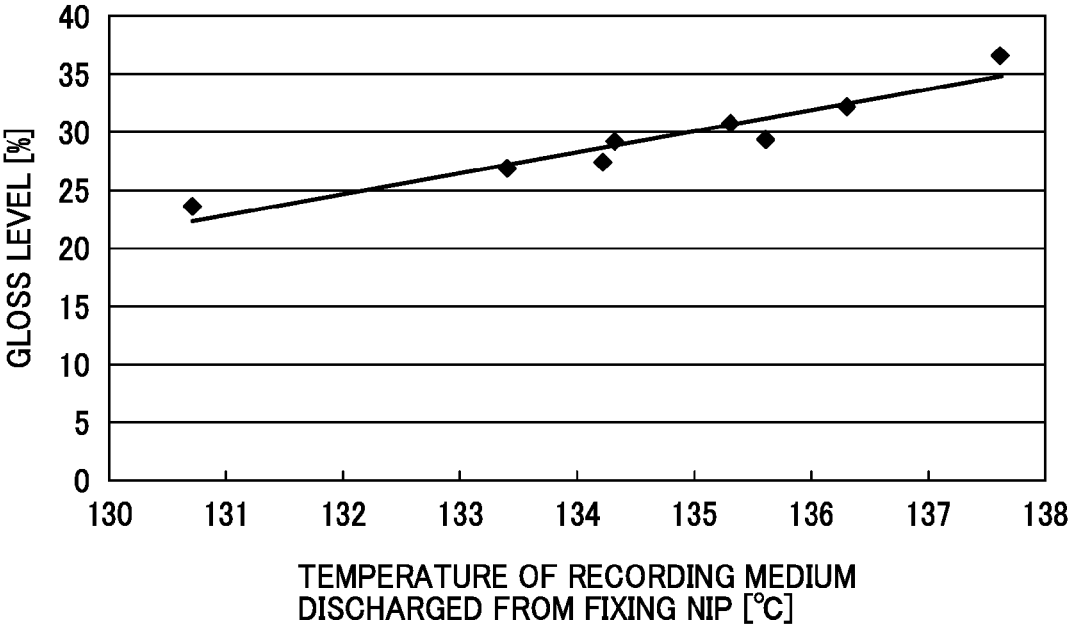
FIG. 11 is a graph showing a relation between the temperature of the recording medium discharged from the fixing nip of the fixing device shown in FIG. 2 and the gloss level of the toner image fixed on the recording medium.

Next, with reference to FIG. 11, a description is given of a relation between the temperature of the recording medium 20 discharged from the fixing nip N and the gloss level of the toner image T fixed on the recording medium 20 that is one of parameters to evaluate quality of the toner image T fixed on the recording medium 20. The gloss level is a parameter representing gloss of the toner image T fixed on the recording medium 20 that is measured with a gloss meter.

FIG. 11 is a graph showing a relation between the temperature of the recording medium 20 discharged from the fixing nip N and the gloss level of the toner image T fixed on the recording medium 20, which is obtained by the measurement described above with reference to FIGS. 3 to 6. As shown in FIG. 11, the temperature of the recording medium 20 discharged from the fixing nip N shows a strong correlation with the gloss level.

The measurement shown in FIG. 11 is performed under the conditions of the measurement shown in FIG. 10. The gradient of an approximate line shown in FIG. 11 provides a gloss level of 15 percent per the temperature of the recording medium 20 discharged from the fixing nip N of 10 degrees centigrade. In order to control the fixing property defining fixing quality, such as the fixing strength and the gloss level, to a desired value, it is required to control the temperature of the recording medium 20 discharged from the fixing nip N to a target temperature. Further, it is preferable to maintain the temperature of the recording medium 20 discharged from the fixing nip N, the fixing strength, and the gloss level at desired given values in view of energy saving. It is because the recording medium 20 having a relatively high temperature when it is discharged from the fixing nip N has consumed an increased amount of heat compared to when the recording medium 20 has a relatively low temperature.

Incidentally, a part of heat may be conducted to the recording medium 20 from the pressing roller 2 and therefore the pressing roller 2 may change the temperature of the recording medium 20 discharged from the fixing nip N substantially. However, heat conduction from the pressing roller 2 to the endless belt 1 may not be controlled, varying the temperature of the recording medium 20 discharged from the fixing nip N.

Figure 12:
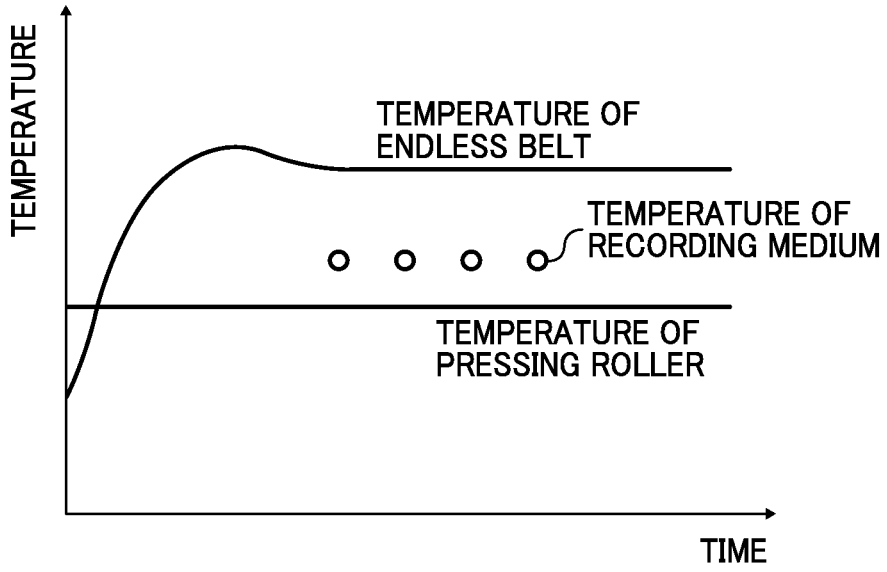
FIG. 12 is a graph showing a relation between time and the temperature of an endless belt and a pressing roller incorporated in the fixing device shown in FIG. 2 and a recording medium conveyed therein when a heater is disposed opposite the pressing roller.

With reference to FIG. 12, a description is provided of the temperature of the recording medium 20 discharged from the fixing nip N changing over time if a heater is disposed opposite the pressing roller 2.

FIG. 12 is a graph showing a relation between time and the temperature of the endless belt 1, the pressing roller 2, and the recording medium 20. If the heater is disposed opposite the pressing roller 2, the temperature of the pressing roller 2 is controlled to be constant regardless of print conditions. As the temperature of the pressing roller 2 is constant, the temperature of the recording medium 20 discharged from the fixing nip N is also constant as shown in FIG. 12, thus maintaining the fixing property.

Figure 13:
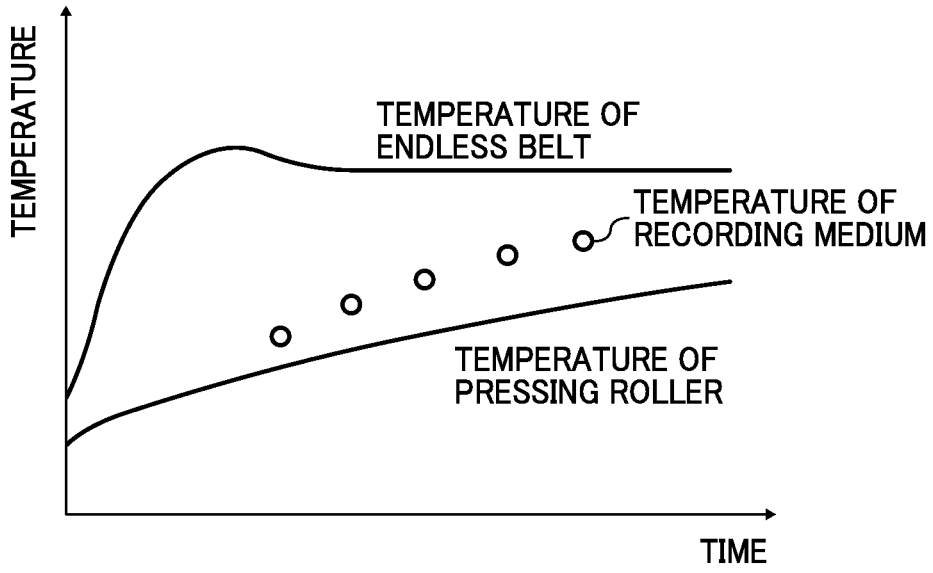
FIG. 13 is a graph showing a relation between time and the temperature of the endless belt, the pressing roller, and the recording medium when no heater is disposed opposite the pressing roller.

With reference to FIG. 13, a description is provided of the temperature of the recording medium 20 discharged from the fixing nip N that changes over time if no heater is disposed opposite the pressing roller 2.

FIG. 13 is a graph showing a relation between time and the temperature of the endless belt 1, the pressing roller 2, and the recording medium 20. In order to heat the front side of the recording medium 20 that bears the unfixed toner image T and prevent the pressing roller 2 in contact with the back side of the recording medium 20 that does not bear the unfixed toner image T from storing heat in view of energy saving, no heater is disposed opposite the pressing roller 2 or, even if a heater is disposed opposite the pressing roller 2, the heater is turned off during printing.

In this case, the pressing roller 2 may have a decreased thermal capacity and therefore may be susceptible to temperature change as an operating condition changes. For example, when the image forming apparatus 400 enters a sleep mode or a plurality of recording media 20 is conveyed through the fixing device 22 continuously, the temperature of the pressing roller 2 may change readily over time. Accordingly, the temperature of the recording medium 20 may also change readily, degrading fixing property or wasting energy.

One method to maintain the temperature of the recording medium 20 discharged from the fixing nip N at a target temperature regardless of change in the temperature of the pressing roller 2 is to locate the temperature sensor 40 as shown in FIG. 3 and perform a feedback control based on the temperature of the recording medium 20 discharged from the fixing nip N directly detected by the temperature sensor 40. However, installation of the relatively expensive temperature sensor 40 may increase manufacturing costs of the image forming apparatus 400.

To address this circumstance, the fixing device 22 employs a fixing device temperature control method to maintain the temperature of the recording medium 20 discharged from the fixing nip N at a target temperature as described below. The control method maintains the temperature of the recording medium 20 discharged from the fixing nip N not based on the temperature of the recording medium 20 detected by the temperature sensor 40 but on correction calculation based on the temperature of the pressing roller 2, thus avoiding increased manufacturing costs caused by installation of the temperature sensor 40.

First, a description is given of simulation performed for the fixing device temperature control method.

Figure 14:
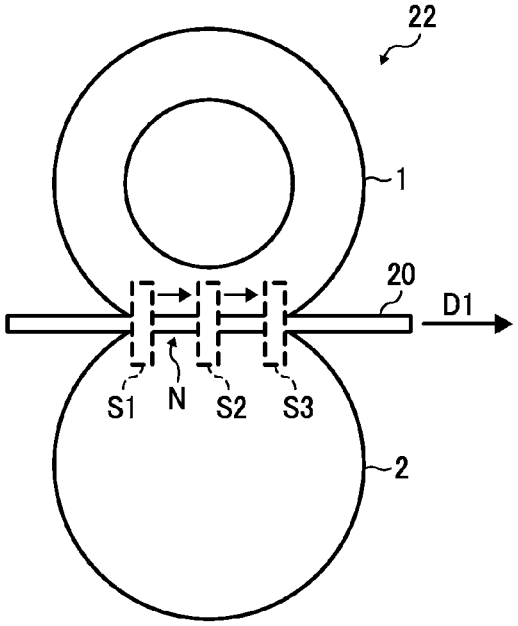
FIG. 14 is a schematic vertical sectional view of the fixing device shown in FIG. 2 for explaining simulation of heat conduction.

As the recording medium 20 is conveyed through the fixing device 22, the recording medium 20 is heated by heat conduction from the endless belt 1 and the pressing roller 2. Accordingly, heat conduction is simulated. FIG. 14 is a schematic vertical sectional view of the fixing device 22 for explaining simulation of heat conduction. Heat conduction from the endless belt 1 to the recording medium 20 as the recording medium 20 is conveyed through the fixing nip N is simulated. FIG. 14 illustrates three simulation positions in the fixing nip N: a first simulation position S1 situated at an entry to the fixing nip N; a second simulation position S2 situated at a middle of the fixing nip N; and a third simulation position S3 situated at the exit of the fixing nip N.

A detailed description is now given of a principle of the simulation.

The temperature of the fixing nip N is calculated by a heat conduction equation (1) below as a basic formula.

$$\rho c\frac{\partial\theta}{\partial t} = \frac{\partial}{\partial x}\left(\lambda\frac{\partial\theta}{\partial x}\right) + \frac{\partial}{\partial y}\left(\lambda\frac{\partial\theta}{\partial y}\right) \tag{1}$$

In the heat conduction equation (1), θ represents a temperature, ρ represents a density of the endless belt 1 in contact with the toner image T on the recording medium 20, c represents a specific heat of the endless belt 1, and λ represents a thermal conductivity of the endless belt 1. Since the heat conduction equation (1) is nonlinear, an analysis solution is not obtained readily.

To address this circumstance, according to this example embodiment, a numerical solution is obtained by approximation using calculus of finite differences, thus simulating the temperature of the recording medium 20 discharged from the fixing nip N.

First, a description is given of a fixing device temperature control method for controlling the temperature of the recording medium 20 discharged from the fixing nip N based on the temperature of the pressing roller 2 detected by the sensor 7.

Figure 15:
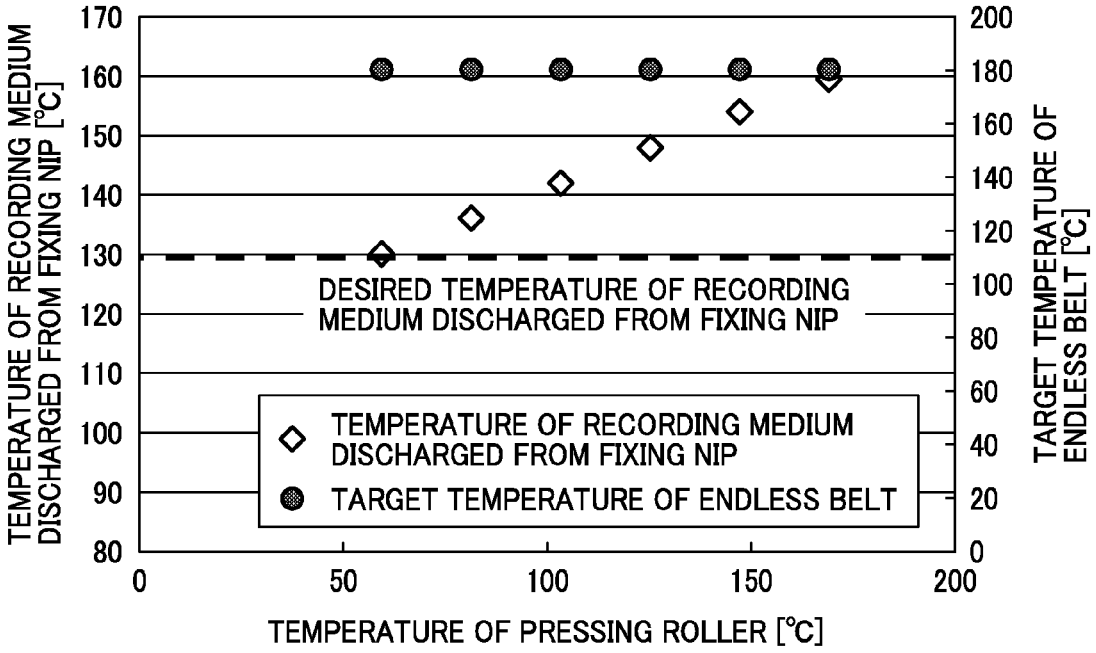
FIG. 15 is a graph showing a relation between the temperature of the pressing roller and the temperature of the recording medium discharged from the fixing nip when a target fixing temperature is constant under a comparative control method.

FIG. 15 is a graph showing a relation between the temperature of the pressing roller 2 and the temperature of the recording medium 20 discharged from the fixing nip N when a target fixing temperature at which the toner image T is fixed on the recording medium 20 is constant under a comparative control method. Under the comparative control method shown in FIG. 15, as the temperature of the pressing roller 2 increases, even if the target fixing temperature is constant, the temperature of the recording medium 20 discharged from the fixing nip N increases. Accordingly, the temperature of the recording medium 20 discharged from the fixing nip N is not maintained at a desired temperature. Without controlling the temperature of the pressing roller 2 that may adversely affect the temperature of the recording medium 20 discharged from the fixing nip N, the temperature of the recording medium 20 discharged from the fixing nip N may not be maintained at a desired temperature.

Figure 16:
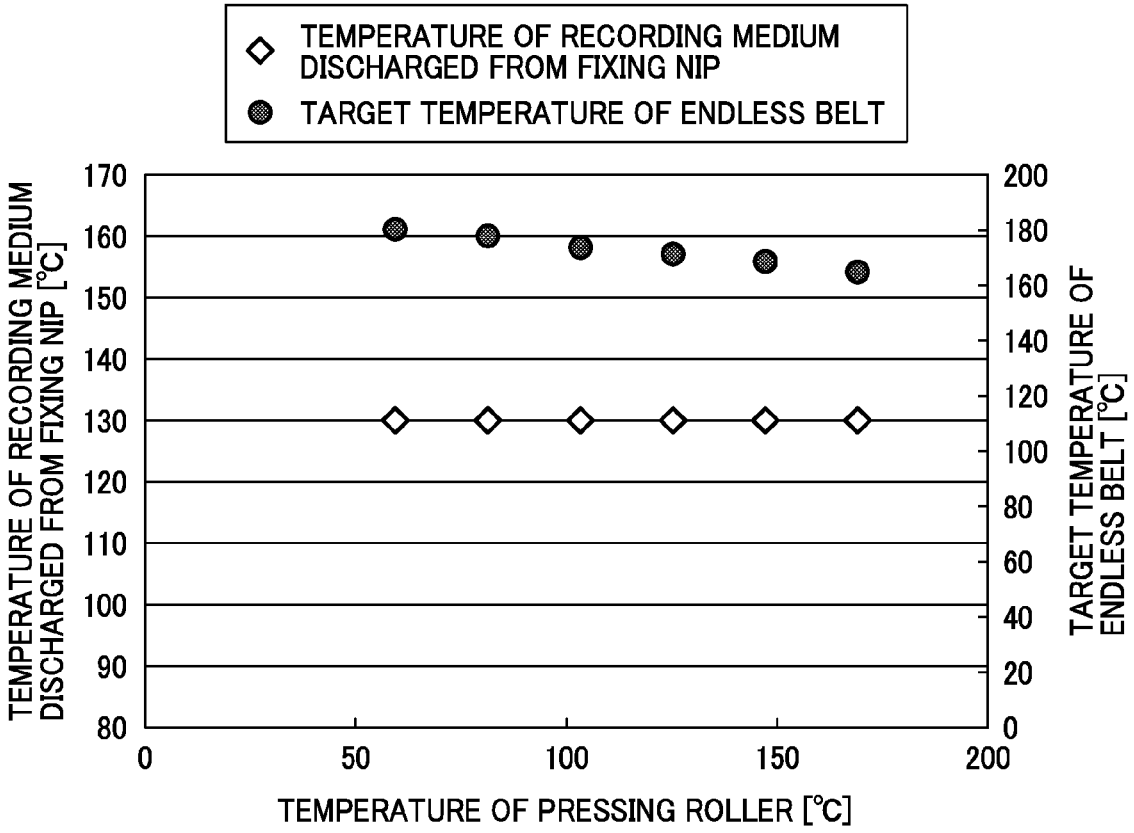
FIG. 16 is a graph showing a relation between the temperature of the pressing roller and the temperature of the recording medium discharged from the fixing nip and a relation between the temperature of the pressing roller and the target temperature of the endless belt.

With reference to FIG. 16, a description is provided of a fixing device temperature control method for controlling the temperature of the endless belt 1 based on the temperature of the pressing roller 2.

FIG. 16 is a graph showing a relation between the temperature of the pressing roller 2 and the temperature of the recording medium 20 discharged from the fixing nip N. The control method shown in FIG. 16 controls the temperature of the recording medium 20 discharged from the fixing nip N to be constant based on the temperature of the pressing roller 2 that may adversely affect the temperature of the recording medium 20 discharged from the fixing nip N substantially.

In order to maintain the temperature of the recording medium 20 discharged from the fixing nip N at a desired temperature, the temperature of the endless belt 1 or the nip conveyance time for which the recording medium 20 is conveyed through the fixing nip N (hereinafter referred to as the nip conveyance time) may be controlled based on the temperature of the pressing roller 2. According to this example embodiment, the temperature of the endless belt 1 is controlled because the recording medium 20 is substantially sensitive to the temperature of the endless belt 1 that is controllable. For example, a target temperature of the endless belt 1 is changed based on the temperature of the pressing roller 2. When the temperature of the pressing roller 2 is relatively high, the temperature of the recording medium 20 discharged from the fixing nip N is maintained at a desired temperature by decreasing the target temperature of the endless belt 1.

Figure 17A:
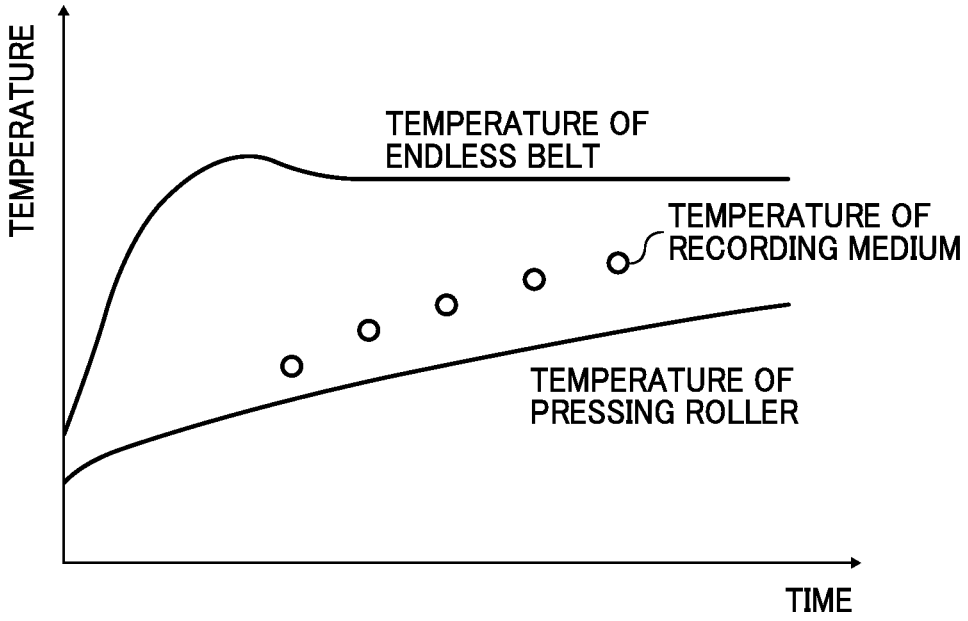
FIG. 17A is a graph showing a relation between time and the temperature of the recording medium when the plurality of recording media is conveyed through the fixing nip under the comparative control method to maintain the target temperature of the endless belt at a target temperature.
Figure 17B:
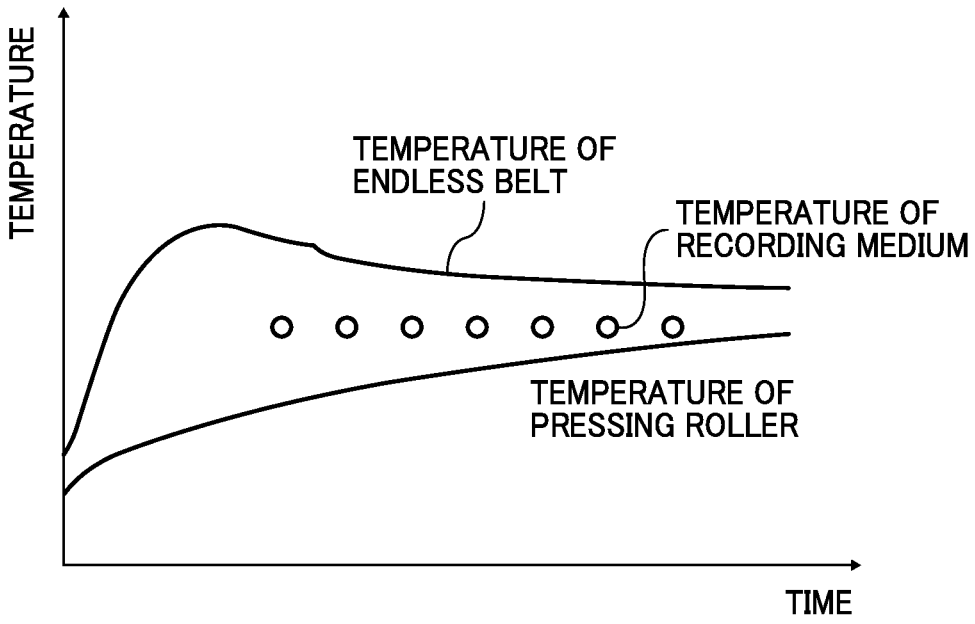
FIG. 17B is a graph showing a relation between time and the temperature of the recording medium when the plurality of recording media is conveyed through the fixing nip under a fixing device temperature control method according to the example embodiment, involving changing the target temperature of the endless belt based on the temperature of the pressing roller.

With reference to FIGS. 17A and 17B, a description is provided of results of a fixing device temperature control method for controlling the temperature of the endless belt 1 based on the temperature of the pressing roller 2.

FIG. 17A is a graph showing a relation between time and the temperature of the recording medium 20 when the plurality of recording media 20 is conveyed through the fixing nip N under the comparative control method to maintain the target temperature of the endless belt 1 at a target temperature. FIG. 17B is a graph showing a relation between time and the temperature of the recording medium 20 when the plurality of recording media 20 is conveyed through the fixing nip N under a fixing device temperature control method according to this example embodiment, involving changing the target temperature of the endless belt 1 based on the temperature of the pressing roller 2.

If the image forming apparatus 400 is an intermediate-speed machine configured to convey recording media 20 at a speed of 30 to 60 sheets of A4 size per minute, for example, the image forming apparatus 400 may frequently convey the plurality of recording media 20 continuously. In this case, the temperature of the pressing roller 2 may change over time. Under the comparative control method shown in FIG. 17A, during a print job for forming a toner image T on a plurality of recording media 20 continuously, the pressing roller 2 stores a decreased amount of heat immediately after the print job starts. Accordingly, the recording medium 20 brought into contact with the pressing roller 2 having a decreased temperature also has a decreased temperature when it is discharged from the fixing nip N. Conversely, the pressing roller 2 stores an increased amount of heat when the print job almost finishes. Accordingly, the recording medium 20 brought into contact with the pressing roller 2 having an increased temperature also has an increased temperature when it is discharged from the fixing nip N. Consequently, quality for fixing the toner image T on the recording media 20 may vary, i.e., deteriorate.

To address this circumstance, according to this example embodiment shown in FIG. 17B, even if the temperature of the pressing roller 2 increases gradually during the print job for printing on the plurality of recording media 20, the temperature of the endless belt 1 is decreased to offset the increased temperature of the pressing roller 2, maintaining the temperature of the recording media 20 at a target temperature and therefore achieving the desired quality for fixing the toner image T on the recording media 20 and saving energy.

Figure 18:
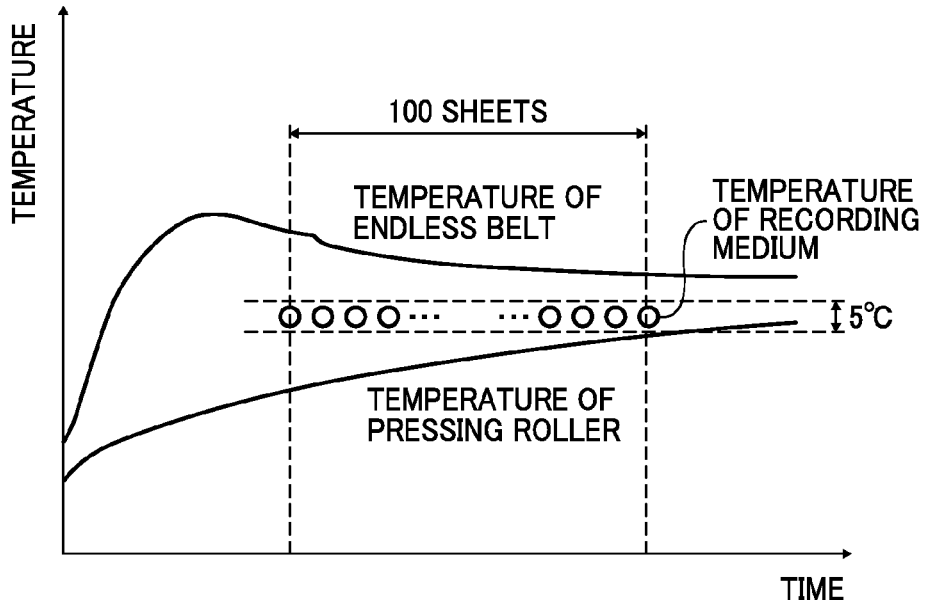
FIG. 18 is a graph showing a relation between time and the temperature of the recording medium when 100 sheets of recording media is conveyed through the fixing nip under the fixing device temperature control method according to the example embodiment, involving changing the target temperature of the endless belt based on the temperature of the pressing roller.

With reference to FIG. 18, a description is provided of an evaluation of a print job for printing on 100 sheets of recording media 20 continuously under the fixing device temperature control method according to this example embodiment.

FIG. 18 is a graph showing a relation between time and the temperature of the recording medium 20 when 100 sheets of recording media 20 is conveyed through the fixing nip N under the fixing device temperature control method according to this example embodiment, involving changing the target temperature of the endless belt 1 based on the temperature of the pressing roller 2.

In typical offices, a print job for printing on thousands of sheets is rarely performed. Accordingly, the evaluation was conducted for a print job for printing on 100 sheets, which is generally performed, to achieve precise evaluation results. Further, the temperature of the recording medium 20 discharged from the fixing nip N was controlled to within 5 degrees centigrade of a target temperature.

A detailed description is now given of fluctuation within 5 degrees centigrade from the target temperature.

An experiment was conducted to examine how change in gloss of a toner image T formed on a recording medium 20 was identified. Printing was performed under conditions shown in table 1 below to obtain samples.

TABLE 1

| | |
|---|---|
| Ambient temperature | 23 degrees centigrade |
| Nip conveyance time | 45 msec |
| Recording medium type | Coated paper having paper weight of 180 g/m$^2$ |
| Toner type | Polyester polymerization black toner |
| Material of surface of endless belt 1 | Tetrafluoroethylene-perfluoroalkylvinylether copolymer (PFA) |

Samples having different gloss levels were prepared under the conditions shown in table 1. For example, the endless belt 1 was heated to a target temperature and left for about 15 minutes until the entire fixing device 22 stored heat sufficiently. After a toner image T was fixed on a recording medium 20, the gloss level was measured with a gloss meter. Specifically, incident light was emitted onto the toner image T on the recording medium 20 at an incident angle of 60 degrees and reflection light reflected by the toner image T was measured with the gloss meter. The incident angle of 60 degrees is generally used for evaluation conducted with the image forming apparatus 400 used in typical offices. The gloss meter was a Uni Gross 60 available from Konica Minolta, Inc. The target temperature of the endless belt 1 was changed gradually to produce the samples having different gloss levels. Three samples were evaluated subjectively by a plurality of subjective evaluators on whether or not the different gloss levels were identifiable.

Figure 19:
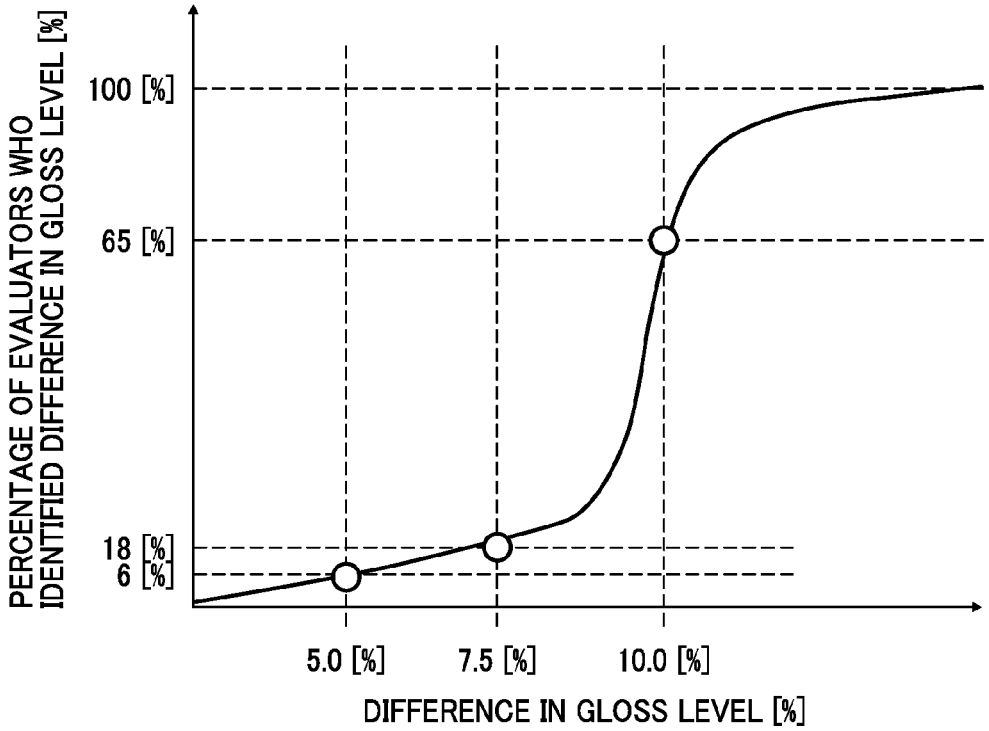
FIG. 19 is a graph showing a relation between the difference in gloss level of samples and the percentage of evaluators who identified the difference in gloss level.

Evaluation results are shown in table 2 below and FIG. 19. FIG. 19 is a graph showing a relation between the difference in gloss level of the samples and the percentage of the evaluators who identified the difference in gloss level.

TABLE 2

| Difference in gloss level | Percentage of evaluators who identified the difference in gloss level |
|---|---|
| 5.0% | 6% |
| 7.5% | 18% |
| 10.0% | 65% |

As shown in FIG. 19, three samples having the differences in gloss level of 5.0 percent, 7.5 percent, and 10.0 percent, respectively, were produced and evaluated. The percentage of evaluators who identified the difference in gloss level substantially increases between the differences in gloss level of 7.5 percent and 10.0 percent. Accordingly, the change in gloss level may be below the threshold of 7.5 percent to improve quality for fixing the toner image T on the recording medium 20. On the other hand, in view of the relation shown in FIG. 11, in order to restrict the change in gloss level to or below the threshold of 7.5 percent, the change in temperature of the endless belt 1 should be within 5 degrees centigrade.

According to this example embodiment, after the temperature of the recording medium 20 discharged from the fixing nip N was maintained substantially at a target temperature during a print job for printing on 100 sheets, fluctuation in temperature of the recording medium 20 discharged from the fixing nip N was within 5 degrees centigrade as shown in FIG. 18.

With reference to FIGS. 20 to 27B, a description is provided of a correction method for correcting for the effect of the temperature of the pressing roller 2 on the temperature of the recording medium 20.

The effect exerted by the temperature of the pressing roller 2 on the temperature of the recording medium 20 varies depending on properties such as the nip conveyance time and the paper weight, the thermal conductivity, the specific heat, and the moisture content of the recording medium 20. Accordingly, the gradient of the target temperature of the endless belt 1 with respect to the temperature of the pressing roller 2 to maintain the temperature of the recording medium 20 discharged from the fixing nip N at a target temperature as shown in FIG. 16 may be corrected by those properties.

A detailed description is now given of the correction method for correcting for the effect of the temperature of the pressing roller 2 on the temperature of the recording medium 20.

Figure 20:
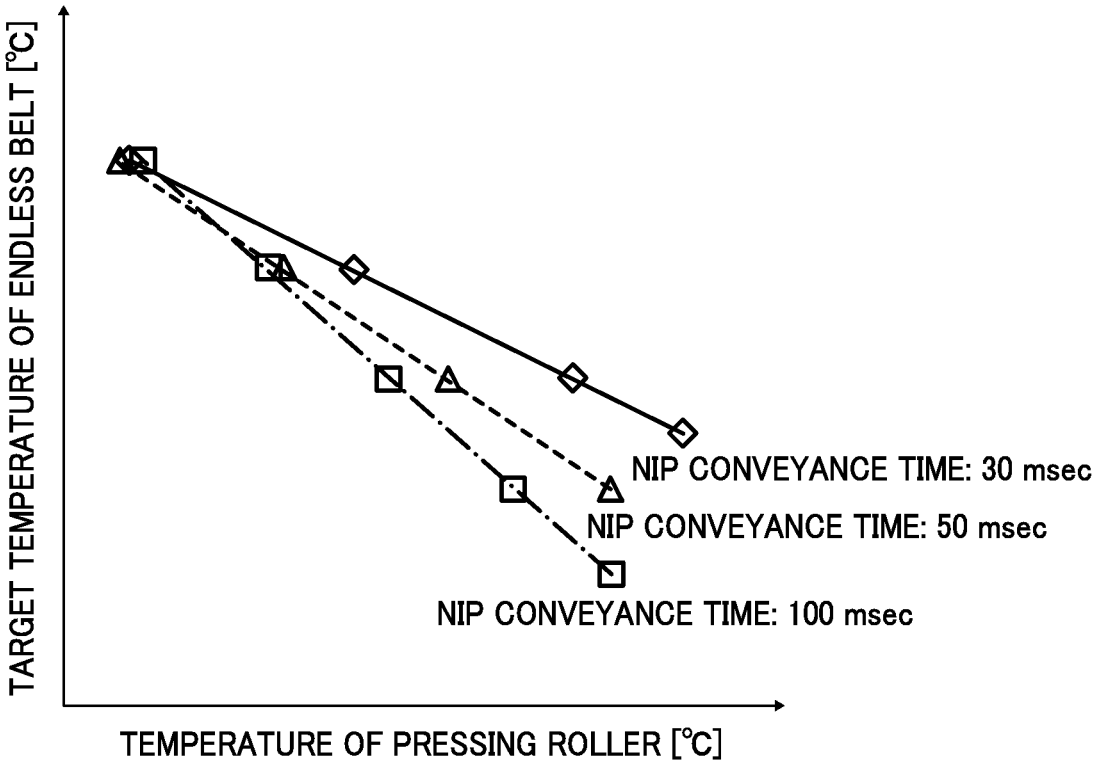
FIG. 20 is a graph showing a relation between the temperature of the pressing roller and the target temperature of the endless belt that achieves an identical temperature of the recording medium discharged from the fixing nip.
Figure 21A:
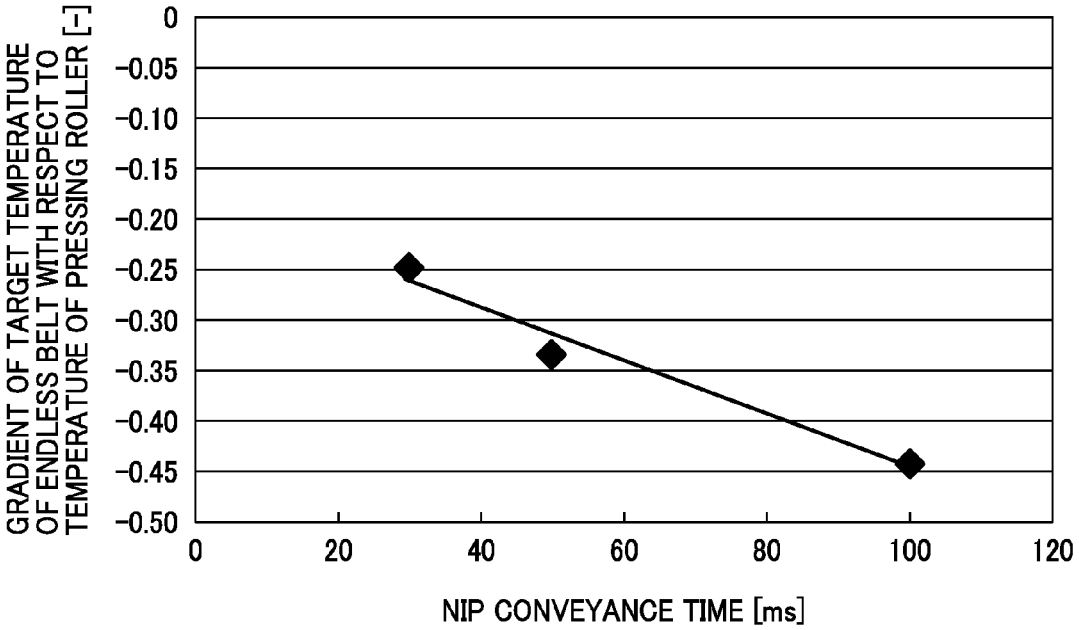
FIG. 21A is a graph showing a relation between the nip conveyance time and the gradient of the target temperature of the endless belt with respect to the temperature of the pressing roller.
Figure 21B:
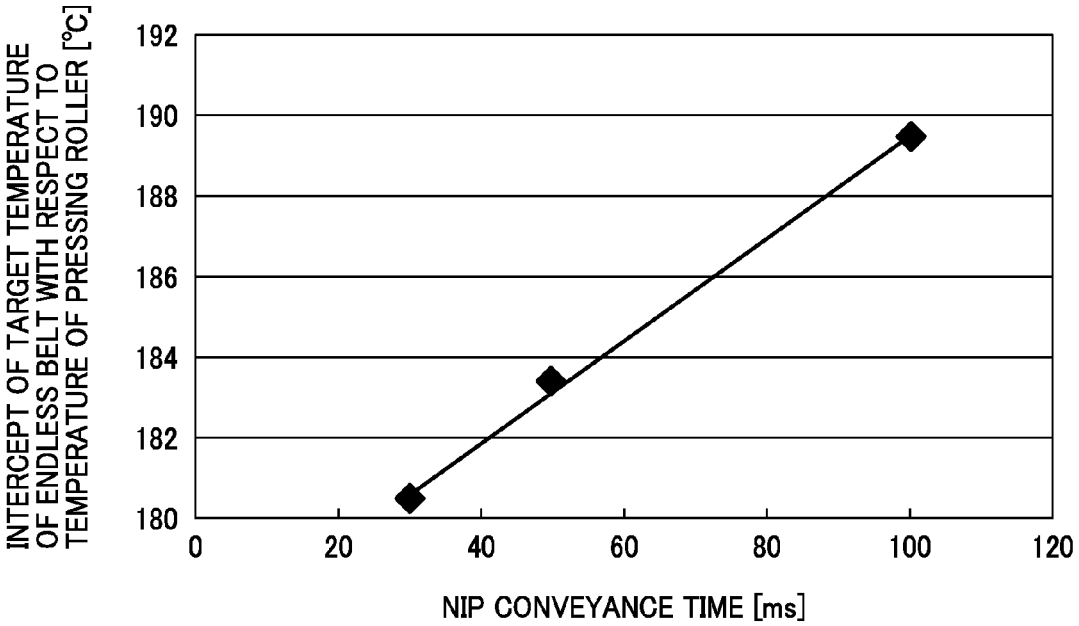
FIG. 21B is a graph showing a relation between the nip conveyance time and the intercept of the target temperature of the endless belt with respect to the temperature of the pressing roller.

With reference to FIGS. 20 to 21B, a description is provided of one example of the correction method in view of the nip conveyance time. The nip conveyance time also varies depending on the operating condition of the fixing device 22. For example, as the endless belt 1 stores more heat, the endless belt 1 expands thermally, changing the fixing nip width W of the fixing nip N depicted in FIG. 2. How the nip conveyance time changes the effect exerted by the temperature of the pressing roller 2 on the temperature of the recording medium 20 was examined by experiment and simulation.

FIG. 20 is a graph showing a relation between the temperature of the pressing roller 2 and the target temperature of the endless belt 1 that achieves an identical temperature of the recording medium 20 discharged from the fixing nip N. The paper weight of the recording medium 20 was 70 $g/m^2$. The thermal conductivity of the recording medium 20 was 0.16 W/(m·K). The specific heat of the recording medium 20 was 1,012 $KJ/(m^3 \cdot K)$. The temperature of the recording medium 20 before entering the fixing nip N was 23 degrees centigrade. The moisture content of the recording medium 20 was 4 percent. As shown in FIG. 20, as the nip conveyance time increases, the gradient of the lines increases.

The gradient of the lines indicates the effect exerted on the temperature of the recording medium 20 by the temperature of the pressing roller 2. The greater the nip conveyance time, the greater the effect exerted on the temperature of the recording medium 20 by the temperature of the pressing roller 2. It is assumed that as the nip conveyance time increases, the pressing roller 2 conducts an increased amount of heat to the recording medium 20.

FIG. 21A is a graph showing a relation between the nip conveyance time and the gradient of the target temperature of the endless belt 1 with respect to the temperature of the pressing roller 2. FIG. 21B is a graph showing a relation between the nip conveyance time and the intercept of the target temperature of the endless belt 1 with respect to the temperature of the pressing roller 2. As shown in FIGS. 21A and 21B, the nip conveyance time shows a strong correlation with the gradient and the intercept of the target temperature of the endless belt 1 with respect to the temperature of the pressing roller 2, drawing approximate lines by regression analysis.

A coefficient of the two approximate lines is obtained in advance and stored in a memory. From the gradient and the intercept of the target temperature of the endless belt 1 with respect to the temperature of the pressing roller 2 indicated by the two approximate lines in FIGS. 21A and 21B, two formulas (2) and (3) below are obtained and coefficients of the formulas (2) and (3) are stored in the memory.

$$y1=-0.0027 \cdot x-0.1812 \quad (2)$$

$$y2=0.1282 \cdot x+176.7 \quad (3)$$

In the formulas (2) and (3), x represents the nip conveyance time, y1 represents the gradient of the target temperature of the endless belt 1 with respect to the temperature of the pressing roller 2, and y2 represents the intercept of the target temperature of the endless belt 1 with respect to the temperature of the pressing roller 2.

Since the nip conveyance time determines y1 and y2, a line indicating the target temperature of the endless belt 1 with respect to the temperature of the pressing roller 2 is shown by a formula (4) below.

$$Y=y1\cdot x+y2 \quad (4)$$

The nip conveyance time may be measured by using a sensor or calculated based on heat storage of the endless belt 1 and the pressing roller 2. Accordingly, the lines are obtained for particular nip conveyance times as shown in FIG. 20. If a sensor (e.g., the sensor 7 depicted in FIG. 2) is configured to detect the temperature of the pressing roller 2, the target temperature of the endless belt 1 is determined based on the lines shown in FIG. 20.

The above-described correction method for correcting for the effect of the temperature of the pressing roller 2 on the temperature of the recording medium 20 applied to the nip conveyance time is also applicable to other properties such as the paper weight, the thermal conductivity, the specific heat, and the moisture content of the recording medium 20. Hence, a description is provided of the correction method applied to the paper weight, the thermal conductivity, the specific heat, and the moisture content of the recording medium 20, respectively.

Figure 22:
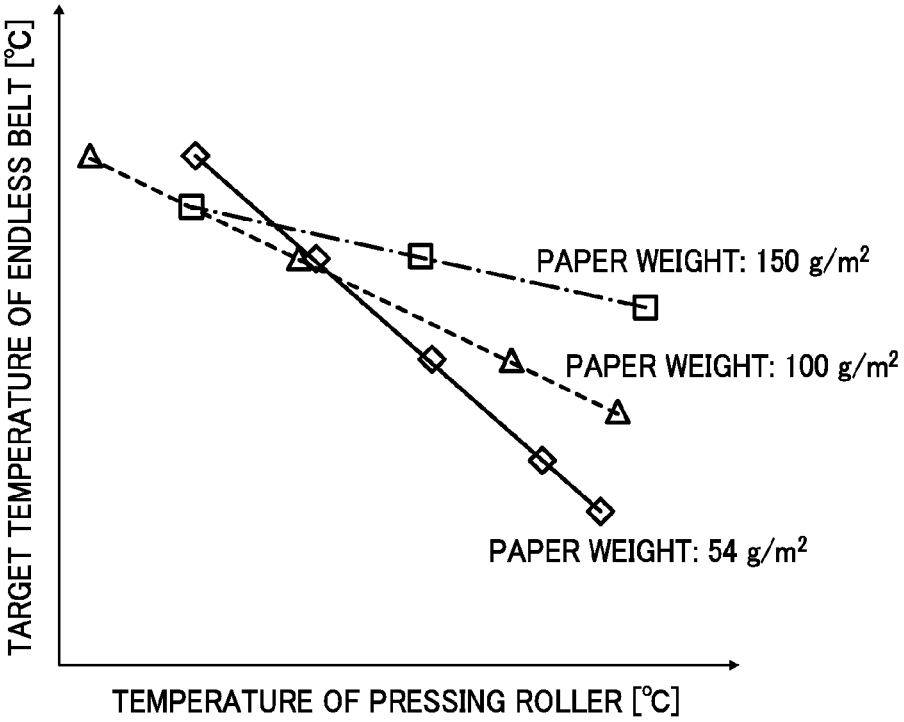
FIG. 22 is a graph showing a relation between the temperature of the pressing roller and the target temperature of the endless belt that achieves an identical temperature of the recording medium discharged from the fixing nip when the paper weight of the recording medium varies.

With reference to FIG. 22, a detailed description is now given of the correction method for correcting for the effect of the temperature of the pressing roller 2 on the temperature of the recording medium 20 that is applied to the paper weight of the recording medium 20.

How the paper weight of the recording medium 20 changes the effect exerted by the temperature of the pressing roller 2 on the temperature of the recording medium 20 was examined by experiment and simulation. FIG. 22 is a graph showing a relation between the temperature of the pressing roller 2 and the target temperature of the endless belt 1 that achieves an identical temperature of the recording medium 20 discharged from the fixing nip N. The paper weights of the recording medium 20 were 150 g/m$^2$, 100 g/m$^2$, and 54 g/m$^2$. The nip conveyance time was 50 msec. The thermal conductivity of the recording medium 20 was 0.16 W/(m·K). The specific heat of the recording medium 20 was 1,012 KJ/(m$^3$·K). The temperature of the recording medium 20 before entering the fixing nip N was 23 degrees centigrade. The moisture content of the recording medium 20 was 4 percent.

As shown in FIG. 22, as the paper weight of the recording medium 20 decreases, the gradient of the lines increases. That is, the smaller the paper weight of the recording medium 20, the greater the effect exerted by the temperature of the pressing roller 2 on the temperature of the recording medium 20. It is assumed that as the paper weight of the recording medium 20 decreases, the pressing roller 2 conducts heat to the recording medium 20 more quickly. Accordingly, data about the effect exerted by the temperature of the pressing roller 2 on the temperature of the recording medium 20 that varies depending on the paper weight of the recording medium 20 is obtained in advance by experiment or simulation as shown in FIG. 22. Using the data, the target temperature of the endless belt 1 is changed based on the temperature of the pressing roller 2 to heat the recording medium 20 to a target temperature.

Figure 23:
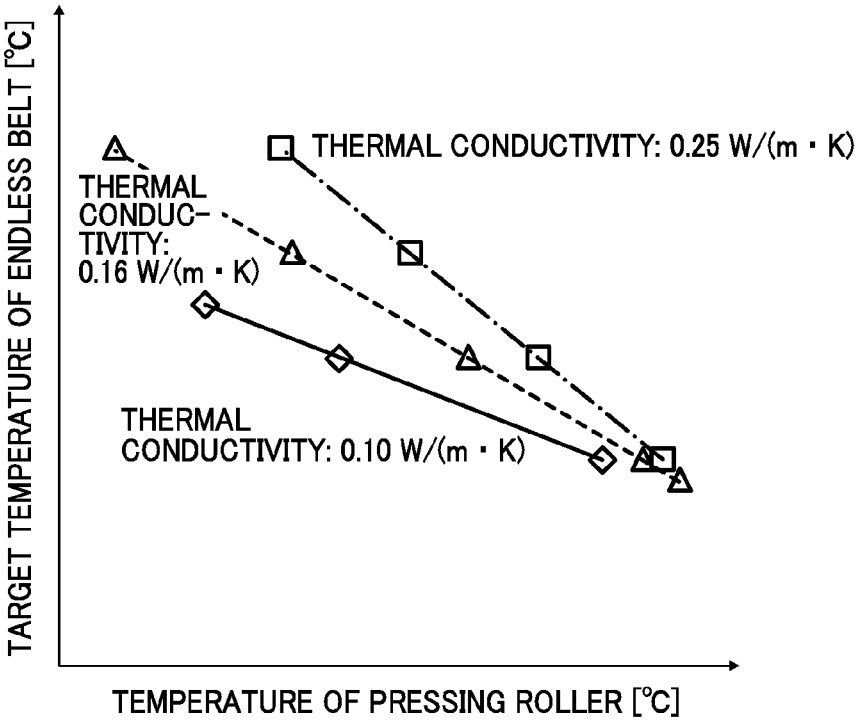
FIG. 23 is a graph showing a relation between the temperature of the pressing roller and the target temperature of the endless belt that achieves an identical temperature of the recording medium discharged from the fixing nip when the thermal conductivity of the recording medium varies.

With reference to FIG. 23, a detailed description is now given of the correction method for correcting for the effect of the temperature of the pressing roller 2 on the temperature of the recording medium 20 that is applied to the thermal conductivity of the recording medium 20.

How the thermal conductivity of the recording medium 20 changes the effect exerted by the temperature of the pressing roller 2 on the temperature of the recording medium 20 was examined by experiment and simulation.

FIG. 23 is a graph showing a relation between the temperature of the pressing roller 2 and the target temperature of the endless belt 1 that achieves an identical temperature of the recording medium 20 discharged from the fixing nip N. The nip conveyance time was 50 msec. The paper weight of the recording medium 20 was 70 g/m$^2$. The thermal conductivities of the recording medium 20 were 0.25 W/(m·K), 0.16 W/(m·K), and 0.10 W/(m·K). The specific heat of the recording medium 20 was 1,012 KJ/(m$^3$·K). The temperature of the recording medium 20 before entering the fixing nip N was 23 degrees centigrade. The moisture content of the recording medium 20 was 4 percent.

As shown in FIG. 23, as the thermal conductivity of the recording medium 20 increases, the gradient of the lines increases. That is, the greater the thermal conductivity of the recording medium 20, the greater the effect exerted by the temperature of the pressing roller 2 on the temperature of the recording medium 20. It is assumed that as the thermal conductivity of the recording medium 20 increases, the pressing roller 2 conducts heat to the recording medium 20 more quickly. Accordingly, data about the effect exerted by the temperature of the pressing roller 2 on the temperature of the recording medium 20 that varies depending on the thermal conductivity of the recording medium 20 is obtained in advance by experiment or simulation as shown in FIG. 23. Using the data, the target temperature of the endless belt 1 is changed based on the temperature of the pressing roller 2 to heat the recording medium 20 to a target temperature.

Figure 24:
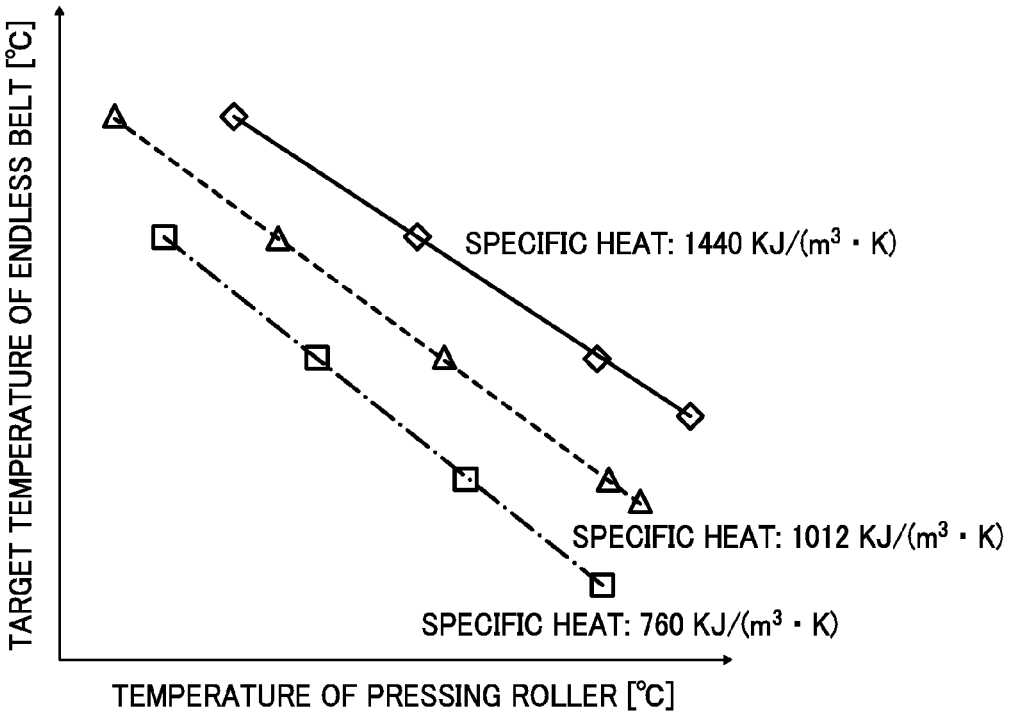
FIG. 24 is a graph showing a relation between the temperature of the pressing roller and the target temperature of the endless belt that achieves an identical temperature of the recording medium discharged from the fixing nip when the specific heat of the recording medium varies.

With reference to FIG. 24, a detailed description is now given of the correction method for correcting for the effect of the temperature of the pressing roller 2 on the temperature of the recording medium 20 that is applied to the specific heat of the recording medium 20.

How the specific heat of the recording medium 20 changes the effect exerted by the temperature of the pressing roller 2 on the temperature of the recording medium 20 was examined by experiment and simulation. FIG. 24 is a graph showing a relation between the temperature of the pressing roller 2 and the target temperature of the endless belt 1 that achieves an identical temperature of the recording medium 20 discharged from the fixing nip N. The nip conveyance time was 50 msec. The paper weight of the recording medium 20 was 70 g/m$^2$. The thermal conductivity of the recording medium 20 was 0.16 W/(m·K). The specific heats of the recording medium 20 were 1,440 KJ/(m$^3$·K), 1,012 KJ/(m$^3$·K), and 760 KJ/(m$^3$·K). The temperature of the recording medium 20 before entering the fixing nip N was 23 degrees centigrade. The moisture content of the recording medium 20 was 4 percent.

As shown in FIG. 24, as the specific heat of the recording medium 20 decreases, the gradient of the lines increases slightly. That is, the smaller the specific heat of the recording medium 20, the greater the effect exerted by the temperature of the pressing roller 2 on the temperature of the recording medium 20. It is assumed that as the specific heat of the recording medium 20 decreases, the pressing roller 2 conducts heat to the recording medium 20 more quickly. Accordingly, data about the effect exerted by the temperature of the pressing roller 2 on the temperature of the recording medium 20 that varies depending on the specific heat of the recording medium 20 is obtained in advance by experiment or simulation as shown in FIG. 24. Using the data, the target temperature of the endless belt 1 is changed based on the temperature of the pressing roller 2 to heat the recording medium 20 to a target temperature.

Figure 25:
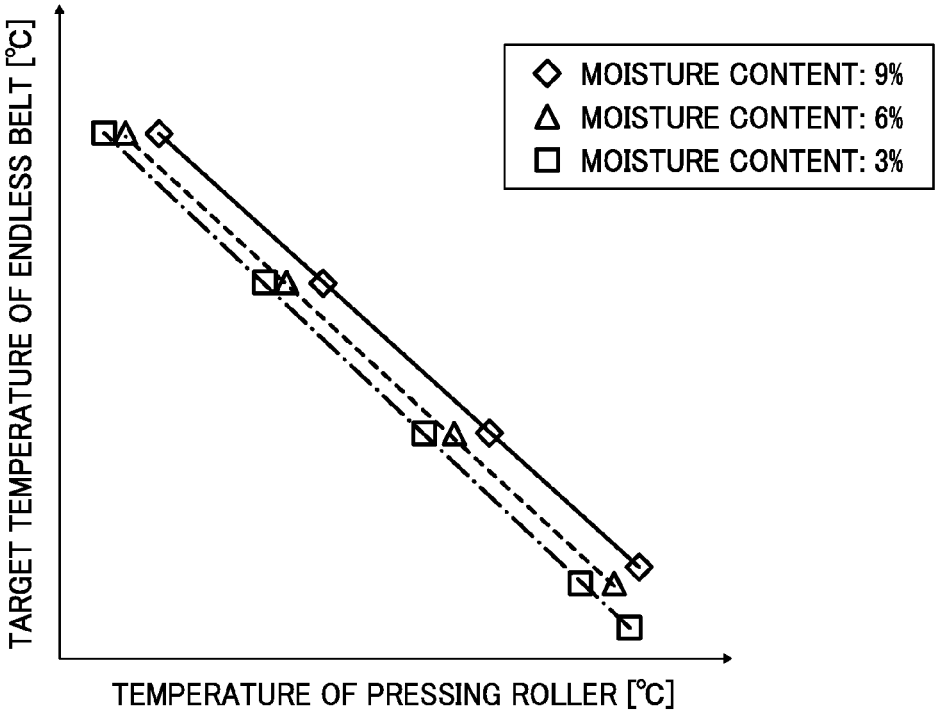
FIG. 25 is a graph showing a relation between the temperature of the pressing roller and the target temperature of the endless belt that achieves an identical temperature of the recording medium discharged from the fixing nip when the moisture content of the recording medium varies.

With reference to FIG. 25, a detailed description is now given of the correction method for correcting for the effect of the temperature of the pressing roller 2 on the temperature of the recording medium 20 that is applied to the moisture content of the recording medium 20 before entering the fixing nip N.

How the moisture content of the recording medium 20 changes the effect exerted by the temperature of the pressing roller 2 on the temperature of the recording medium 20 was examined by experiment and simulation. FIG. 25 is a graph showing a relation between the temperature of the pressing roller 2 and the target temperature of the endless belt 1 that achieves an identical temperature of the recording medium 20 discharged from the fixing nip N. The nip conveyance time was 50 msec. The paper weight of the recording medium 20 was 70 g/m$^2$. The thermal conductivity of the recording medium 20 was 0.16 W/(m·K). The specific heat of the recording medium 20 was 1,012 KJ/(m$^3$·K). The temperature of the recording medium 20 before entering the fixing nip N was 23 degrees centigrade. The moisture contents of the recording medium 20 were 9 percent, 6 percent, and 3 percent.

As shown in FIG. 25, as the moisture content of the recording medium 20 decreases, the gradient of the lines increases slightly. It is assumed that as the moisture content of the recording medium 20 decreases, the pressing roller 2 conducts heat to the recording medium 20 with an increased, apparent thermal conductivity. Accordingly, data about the effect exerted by the temperature of the pressing roller 2 on the temperature of the recording medium 20 that varies depending on the moisture content of the recording medium 20 is obtained in advance by experiment or simulation as shown in FIG. 25. Using the data, the target temperature of the endless belt 1 is changed based on the temperature of the pressing roller 2 to heat the recording medium 20 to a target temperature.

That is, the smaller the moisture content of the recording medium 20 before entering the fixing nip N, the greater the effect exerted by the temperature of the pressing roller 2 on the temperature of the recording medium 20. According to this example embodiment, by considering the moisture content of the recording medium 20 in addition to the temperature of the pressing roller 2, the recording medium 20 is heated to a target temperature.

According to the example embodiments described above, in view of one of the five properties, that is, the nip conveyance time, the paper weight, the thermal conductivity, the specific heat, and the moisture content of the recording medium 20, the effect exerted by the temperature of the pressing roller 2 on the temperature of the recording medium 20 is calculated, thus determining the target temperature of the endless belt 1. Alternatively, by combination of two or more of the five properties, the temperature of the recording medium 20 is calculated more precisely. As a result, the temperature of the recording medium 20 is controlled within a decreased temperature range.

Figure 26A:
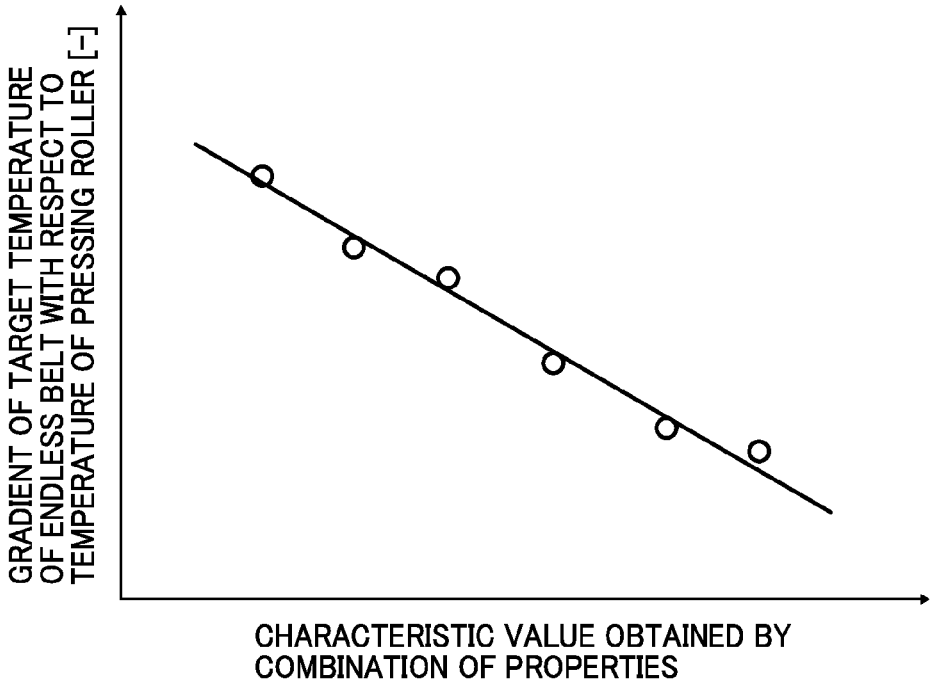
FIG. 26A is a graph showing a relation between the characteristic value obtained by combining two or more of five properties of the recording medium and the gradient of the target temperature of the endless belt with respect to the temperature of the pressing roller.
Figure 26B:
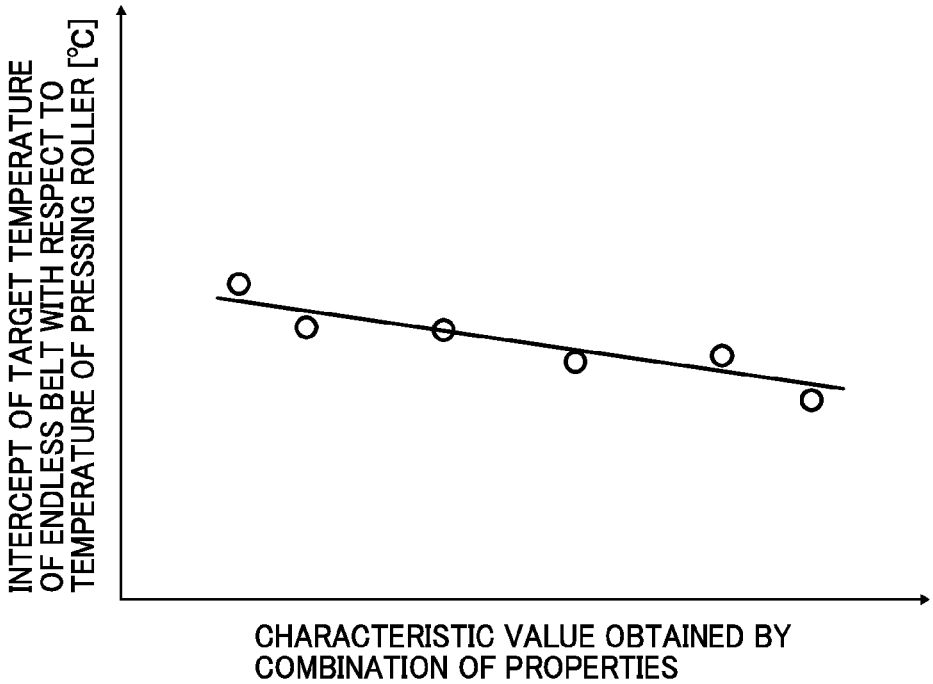
FIG. 26B is a graph showing a relation between the characteristic value obtained by combining two or more of five properties of the recording medium and the intercept of the target temperature of the endless belt with respect to the temperature of the pressing roller.

With reference to FIGS. 26A and 26B, a description is provided of a correction control method for correcting for the effect of the temperature of the pressing roller 2 on the temperature of the recording medium 20 in view of two or more of the five properties.

A characteristic value is obtained by combining two or more properties. For example, the characteristic value is obtained by multiple regression analysis by considering the properties that may change the effect exerted by the temperature of the pressing roller 2 on the temperature of the recording medium 20. That is, the characteristic value that indicates the gradient and the intercept of the approximate line of the target temperature of the endless belt 1 with respect to the pressing roller 2 is obtained.

FIG. 26A is a graph showing a relation between the characteristic value obtained by combining two or more of the five properties and the gradient of the target temperature of the endless belt 1 with respect to the temperature of the pressing roller 2. FIG. 26B is a graph showing a relation between the characteristic value obtained by combining two or more of the five properties and the intercept of the target temperature of the endless belt 1 with respect to the temperature of the pressing roller 2. The graphs in FIGS. 26A and 26B show the characteristic value obtained by combining the paper weight and the thermal conductivity of the recording medium 20 as the two properties. The nip conveyance time was 50 msec. The specific heat of the recording medium 20 was 1,012 KJ/(m$^3$·K). The moisture content of the recording medium 20 was 4 percent.

The characteristic value is obtained by dividing the thermal conductivity of the recording medium 20 by the paper weight of the recording medium 20 as below. When the thermal conductivity of the recording medium 20 is 0.10 W/(m·K) and the paper weight of the recording medium 20 is 100 g/m$^2$, the characteristic value is 0.00100. When the thermal conductivity of the recording medium 20 is 0.10 W/(m·K) and the paper weight of the recording medium 20 is 80 g/m$^2$, the characteristic value is 0.00125. When the thermal conductivity of the recording medium 20 is 0.16 W/(m·K) and the paper weight of the recording medium 20 is 100 g/m$^2$, the characteristic value is 0.00160. When the thermal conductivity of the recording medium 20 is 0.16 W/(m·K) and the paper weight of the recording medium 20 is 80 g/m$^2$, the characteristic value is 0.00200. When the thermal conductivity of the recording medium 20 is 0.25 W/(m·K) and the paper weight of the recording medium 20 is 100 g/m$^2$, the characteristic value is 0.00250. When the thermal conductivity of the recording medium 20 is 0.25 W/(m·K) and the paper weight of the recording medium 20 is 80 g/m$^2$, the characteristic value is 0.00313.

Figure 27A:
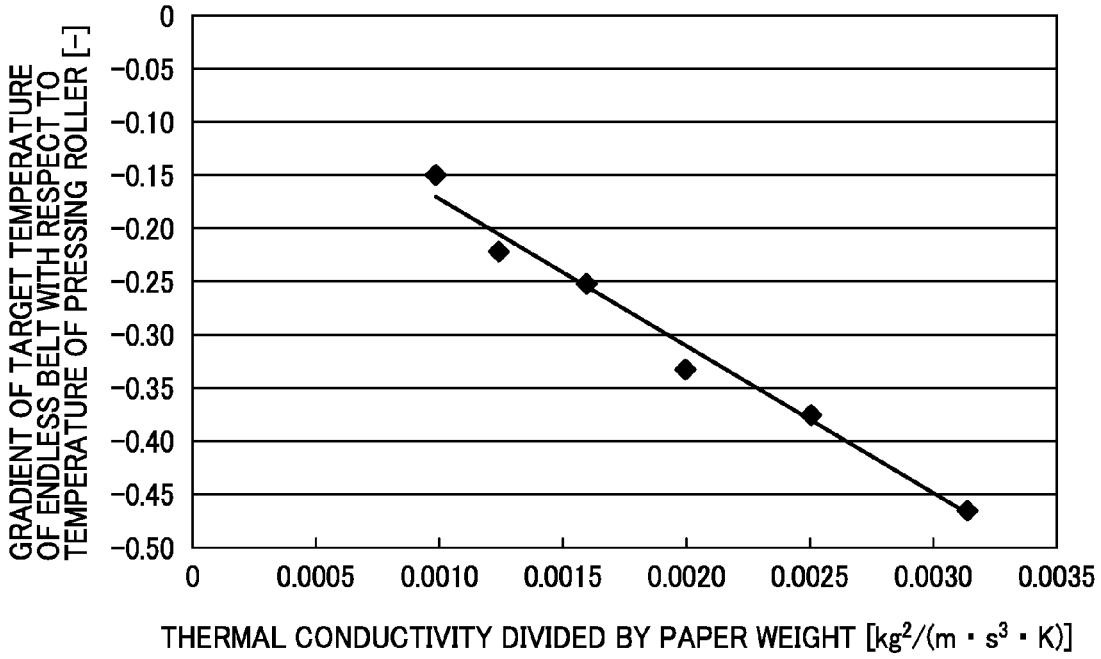
FIG. 27A is a graph showing a relation between the characteristic value obtained by dividing the thermal conductivity of the recording medium by the paper weight of the recording medium and the gradient of the target temperature of the endless belt with respect to the temperature of the pressing roller.
Figure 27B:
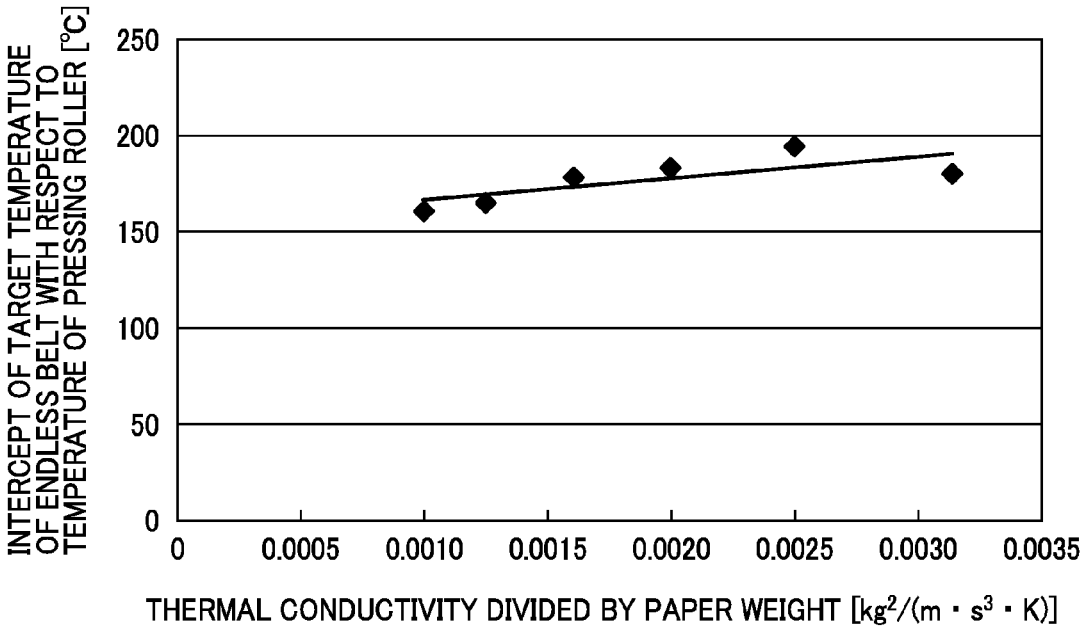
FIG. 27B is a graph showing a relation between the characteristic value obtained by dividing the thermal conductivity of the recording medium by the paper weight of the recording medium and the intercept of the target temperature of the endless belt with respect to the temperature of the pressing roller.

FIG. 27A is a graph showing a relation between the characteristic value obtained by dividing the thermal conductivity of the recording medium 20 by the paper weight of the recording medium 20 and the gradient of the target temperature of the endless belt 1 with respect to the temperature of the pressing roller 2. FIG. 27B is a graph showing a relation between the characteristic value obtained by dividing the thermal conductivity of the recording medium 20 by the paper weight of the recording medium 20 and the intercept of the target temperature of the endless belt 1 with respect to the temperature of the pressing roller 2.

As shown in FIGS. 27A and 27B, the greater the characteristic value, the smaller the gradient of the target temperature of the endless belt 1 with respect to the temperature of the pressing roller 2. Such relation is obvious from the results of the thermal conductivity shown in FIG. 23 and the paper weight shown in FIG. 22. Accordingly, data about the gradient of the target temperature of the endless belt 1 with respect to the temperature of the pressing roller 2 that varies depending on the characteristic value is obtained in advance by experiment or simulation as shown in FIG. 27A. Using the data, the gradient of the line indicating the relation between the target temperature of the pressing roller 2 and the target temperature of the endless belt 1 is obtained. Further, based on the obtained gradient, the target temperature of the endless belt 1 corresponding to the temperature of the pressing roller 2 is obtained. Based on the obtained target temperature of the endless belt 1, the recording medium 20 is heated to a target temperature.

Like the correction control method using one of the five properties described above, the target temperature of the endless belt 1 is also controlled with a correction control method by combination of two of the five properties, thus heating the recording medium 20 to a target temperature. Similarly, the target temperature of the endless belt 1 is also controlled with a correction control method by combination of three or more of the five properties that creates the characteristic value.

With reference to FIGS. 2 and 3, a description is provided of advantages of the fixing device 22 performing the fixing device temperature control method involving the correction control method described above.

The fixing device 22 includes a heat conductor (e.g., the endless belt 1) contacting a first side of a recording medium 20 that bears an unfixed toner image T and heated by electromagnetic induction and in turn heating the recording medium 20; a pressing roller (e.g., the pressing roller 2) pressed against the heat conductor to form the fixing nip N therebetween through which the recording medium 20 is conveyed as the pressing roller contacts a second side of the recording medium 20 and presses the recording medium 20 against the heat conductor; and a heater (e.g., the coil 4) disposed opposite and heating the heat conductor by electromagnetic induction. The heat conductor and the pressing roller apply heat and pressure to the recording medium 20 to fix the toner image T on the recording medium 20. The fixing device 22 performs a fixing device temperature control method to control an input voltage input to the heater to change an amount of heat conducted from the heat conductor to the recording medium 20 so that the recording medium 20 has a target temperature when the recording medium 20 is discharged from the fixing nip N.

The fixing device temperature control method controls the temperature of the recording medium 20 discharged from the fixing nip N to a target temperature. Accordingly, the fixing device temperature control method substantially maintains quality of the toner image T fixed on the recording medium 20 and prevents overheating of the recording medium 20 and the toner image T formed thereon, reducing energy consumption of the fixing device 22.

Figure 28:
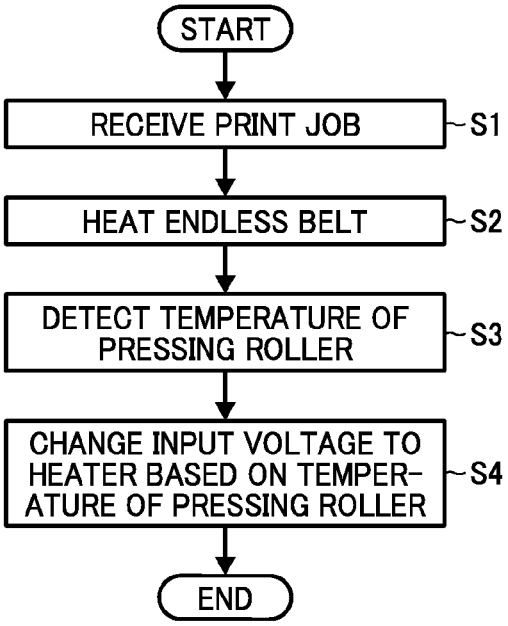
FIG. 28 is a flowchart illustrating a first example of control processes of the fixing device temperature control method according to the example embodiment.

With reference to FIG. 28, a description is provided of a first example of control processes of the fixing device temperature control method described above with reference to FIG. 17B.

FIG. 28 is a flowchart illustrating the first example of the control processes of the fixing device temperature control method. As shown in FIG. 28, in step S1, the image forming apparatus 400 depicted in FIG. 1 receives a print job. In step S2, the power controller 92*b* depicted in FIG. 2 supplies power to the coil 4 to heat the endless belt 1. In step S3, the sensor 7 detects the temperature of the pressing roller 2 and sends information about the detected temperature to the temperature controller 92*a*. In step S4, the power controller 92*b* changes an input voltage to the coil 4 based on information about the temperature of the pressing roller 2 sent from the temperature controller 92*a*. For example, the power controller 92*b* decreases the input voltage to the coil 4 to decrease the temperature of the endless belt 1 as the temperature of the pressing roller 2 increases, offsetting the increased temperature of the pressing roller 2 and thereby maintaining the temperature of the recording media 20 discharged from the fixing nip N at a target temperature.

Figure 29:
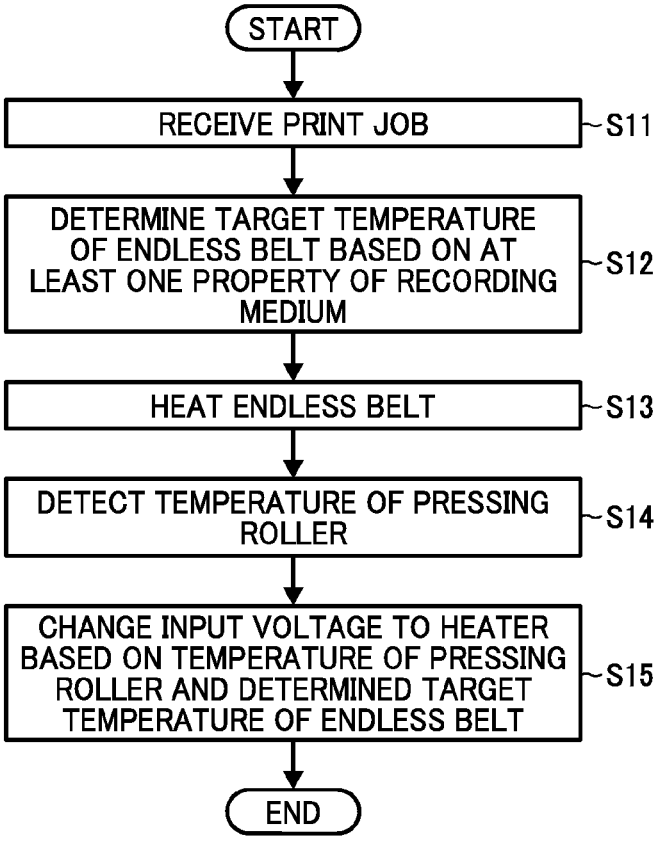
FIG. 29 is a flowchart illustrating a second example of control processes of the fixing device temperature control method according to the example embodiment.

With reference to FIG. 29, a description is provided of a second example of control processes of the fixing device temperature control method described above with reference to FIGS. 20 to 25.

FIG. 29 is a flowchart illustrating the second example of the control processes of the fixing device temperature control method. As shown in FIG. 29, in step S11, the image forming apparatus 400 depicted in FIG. 1 receives a print job. In step S12, the power controller 92*b* depicted in FIG. 2 determines the target temperature of the endless belt 1 based on at least one property of the recording medium 20, that is, at least one of the nip conveyance time, the temperature of the recording medium 20 before entering the fixing nip N, and the paper weight, the thermal conductivity, the specific heat, and the moisture content of the recording medium 20. In step S13, the power controller 92*b* supplies power to the coil 4 to heat the endless belt 1. In step S14, the sensor 7 detects the temperature of the pressing roller 2 and sends information about the detected temperature to the temperature controller 92*a*. In step S15, the power controller 92*b* changes an input voltage to the coil 4 based on information about the temperature of the pressing roller 2 sent from the temperature controller 92*a* and the target temperature of the endless belt 1 determined based on the at least one property of the recording medium 20.

According to the example embodiments described above, the endless belt 1 serves as a heat conductor. Alternatively, a roller, a film, or the like may be used as a heat conductor. Further, as used herein, the term "pressing roller" is not to be limited to a roller as commonly known but is to be understood to include all types of rotating bodies, included belts, bands, and the like.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A fixing device temperature control method performed by a fixing device including:

a heat conductor contacting and heating an unfixed toner image formed on a recording medium;

a heater disposed opposite and heating the heat conductor, the heater includes a coil to heat the heat conductor by electromagnetic induction; and a pressing roller pressed against the heat conductor to form a fixing nip between the heat conductor and the pressing roller through which the recording medium is conveyed, the fixing device temperature control method comprising:

detecting a temperature of the pressing roller; and controlling an input voltage to the heater based on the detected temperature of the pressing roller to maintain a temperature of the recording medium discharged from the fixing nip at a target temperature, wherein:

controlling the input voltage to the heater is performed during a print job for forming the toner image on a plurality of recording medium continuously, controlling the input voltage to the heater so as to maintain the temperature of the recording medium discharged from the fixing nip to within 5 degrees centigrade of the target temperature, controlling the input voltage to the heater is performed based on the detected temperature of the pressing roller by feedback control, and controlling the input voltage to the heater based on calculation in view of a temperature of the recording medium before entering the fixing nip.

2. The fixing device temperature control method according to claim 1, wherein controlling the input voltage to the heater is based on calculation in view of at least one of a nip conveyance time for which the recording medium is conveyed through the fixing nip, a paper weight, a thermal capacity, a specific heat, and a moisture content of the recording medium.

3. The fixing device temperature control method according to claim 1, wherein the temperature of the pressing roller is controlled to be constant.

4. The fixing device temperature control method according to claim 1, wherein the temperature of the recording medium discharged from the fixing nip is controlled to be constant.

5. The fixing device temperature control method according to claim 1, wherein controlling the input voltage to the heater is based on calculation in view of a nip conveyance time for which the recording medium is conveyed through the fixing nip.

6. The fixing device temperature control method according to claim 1, further comprising a temperature sensor located at an exit of the fixing nip to detect the temperature of the recording medium discharged from the fixing nip.

7. A fixing device comprising:

a heat conductor contacting and heating an unfixed toner image formed on a recording medium;

a heater disposed opposite and heating the heat conductor, the heater includes a coil to heat the heat conductor by electromagnetic induction;

a pressing roller pressed against the heat conductor to form a fixing nip between the heat conductor and the pressing roller through which the recording medium is conveyed;

a pressing roller sensor disposed opposite the pressing roller to detect a temperature of the pressing roller;

a temperature controller operatively connected to the pressing roller sensor; and a power controller operatively connected to the temperature controller and the heater to control an input voltage to the heater based on the temperature of the pressing roller detected by the pressing roller sensor to maintain a temperature of the recording medium discharged from the fixing nip at a target temperature, wherein the power controller is configured to control the input voltage to the heater is during a print job for forming the toner image on a plurality of recording medium continuously, wherein the power controller is configured to control the input voltage to the heater to maintain the temperature of the recording medium discharged from the fixing nip to within 5 degrees centigrade of the target temperature, wherein the power controller is configured to control the input voltage to the heater based on the detected temperature of the pressing roller by feedback control, and wherein the power controller is configured to control the input voltage to the heater based on calculation in view of a temperature of the recording medium before entering the fixing nip.

8. The fixing device according to claim 7, wherein the power controller is configured to control the input voltage to the heater to decrease the temperature of the heat conductor as the temperature of the pressing roller increases during a print job for forming the toner image on a plurality of recording media continuously.

9. The fixing device according to claim 8, further comprising a recording medium sensor disposed downstream from the fixing nip in a recording medium conveyance direction to detect the temperature of the recording medium discharged from the fixing nip, wherein the power controller is configured to control the input voltage to the heater to maintain the temperature of the recording medium detected by the recording medium sensor to within 5 degrees centigrade of the target temperature.

10. The fixing device according to claim 7, further comprising a heat conductor sensor operatively connected to the temperature controller and disposed opposite the heat conductor to detect a temperature of the heat conductor.

11. The fixing device according to claim 7, wherein the heat conductor includes an endless belt.

12. An image forming apparatus comprising the fixing device according to claim 7.

13. The fixing device according to claim 7, wherein the temperature of the pressing roller is controlled to be constant.

14. The fixing device according to claim 7, wherein the temperature of the recording medium discharged from the fixing nip is controlled to be constant.

15. The fixing device according to claim 7, wherein the recording medium sensor is spaced apart from an exit of the fixing nip by a distance in a range of approximately 10 mm to 30 mm.

16. The fixing device according to claim 7, wherein the recording medium sensor is situated at a position where the recording medium sensor detects the temperature of the recording medium when a time in a range of approximately 50 msec to 300 msec elapses after the recording medium is discharged from the fixing nip.

17. The fixing device according to claim 7, wherein the power controller controls the input voltage to the heater is based on calculation in view of a nip conveyance time for which the recording medium is conveyed through the fixing nip.

18. The fixing device according to claim 7, further comprising a temperature sensor located at an exit of the fixing nip to detect the temperature of the recording medium discharged from the fixing nip.

19. An image forming apparatus temperature control method performed by a fixing device including:

a heat conductor contacting and heating an unfixed toner image formed on a recording medium;

a heater disposed opposite and heating the heat conductor, the heater includes a coil to heat the heat conductor by electromagnetic induction; and a pressing roller pressed against the heat conductor to form a fixing nip between the heat conductor and the pressing roller through which the recording medium is conveyed, the image forming apparatus temperature control method comprising:

detecting a temperature of the pressing roller; and controlling an input voltage to the heater based on the detected temperature of the pressing roller to maintain a temperature of the recording medium discharged from the fixing nip at a target temperature, wherein:

controlling the input voltage to the heater is performed during a print job for forming the toner image on a plurality of recording medium continuously, controlling the input voltage to the heater so as to maintain the temperature of the recording medium discharged from the fixing nip to within 5 degrees centigrade of the target temperature, controlling the input voltage to the heater is performed based on the detected temperature of the pressing roller by feedback control, and controlling the input voltage to the heater based on calculation in view of a paper weight of the recording medium.

* * * * *